US010332391B2

(12) United States Patent
Fowe et al.

(10) Patent No.: US 10,332,391 B2
(45) Date of Patent: Jun. 25, 2019

(54) SPLIT LANE TRAFFIC JAM DETECTION AND REMEDIATION

(71) Applicant: HERE GLOBAL B.V., Eindhoven (NL)

(72) Inventors: James Fowe, Chicago, IL (US); Filippo Pellolio, Chicago, IL (US)

(73) Assignee: HERE GLOBAL B.V., Eindhoven (NL)

( * ) Notice: Subject to any disclaimer, the term of this patent is extended or adjusted under 35 U.S.C. 154(b) by 286 days.

(21) Appl. No.: 15/370,337

(22) Filed: Dec. 6, 2016

(65) Prior Publication Data

US 2018/0158326 A1 Jun. 7, 2018

(51) Int. Cl.
*G08G 1/01* (2006.01)
*G08G 1/052* (2006.01)

(52) U.S. Cl.
CPC ..... *G08G 1/0133* (2013.01); *G08G 1/0112* (2013.01); *G08G 1/0141* (2013.01); *G08G 1/052* (2013.01)

(58) Field of Classification Search
CPC .... G08G 1/0133; G08G 1/052; G08G 1/0112; G08G 1/0141
See application file for complete search history.

(56) References Cited

U.S. PATENT DOCUMENTS 6,721,650 B2 4/2004 Fushiki et al.
9,330,565 B2 5/2016 Petty et al.
9,569,960 B2 * 2/2017 Xu ..... G08G 1/0125
2002/0045985 A1 4/2002 Kerner
(Continued)

FOREIGN PATENT DOCUMENTS

DE 102013007867 A1 12/2013
WO WO 2012/023016 A1 2/2012

OTHER PUBLICATIONS

Asakura, Yasuo, et al., "Incident Detection Methods Using Probe Vehicles with On-Board GPS Equipment", *Transportation Research Procedia*, 2015, pp. 17-27, vol. 6, Elsevier, B.V., Netherlands.
(Continued)

*Primary Examiner* — Thomas Ingram
(74) *Attorney, Agent, or Firm* — Alston & Bird LLP

(57) ABSTRACT

A plurality of instances of pre-intersection and post-intersection probe data are received. Each instance of pre-intersection probe data corresponds to traveling along a pre-intersection road segment before traveling through an intersection. Each instance of post-intersection probe data corresponds to traveling along a post-intersection road segment following traveling through the intersection. Instances of pre-intersection probe data are clustered into pre-intersection clusters based on a post-intersection road segment identified by the corresponding instance of post-intersection probe data. Instances of post-intersection probe data are clustered into post-intersection clusters based on the post-intersection road segment identified thereby. A traffic level indicator is determined for each cluster. A traffic level indicator difference is determined for each pair of corresponding pre-intersection and post-intersection clusters. Responsive to determining that at least one traffic level indicator difference is greater than a threshold traffic level indicator difference, the intersection is identified as experiencing a traffic jam.

20 Claims, 6 Drawing Sheets

(56) References Cited

U.S. PATENT DOCUMENTS

| | | | | |
|---|---|---|---|---|
| 2006/0064234 | A1 | 3/2006 | Kumagai et al. | |
| 2010/0138141 | A1* | 6/2010 | Hayashida | G01C 21/26 701/118 |
| 2011/0276257 | A1 | 11/2011 | Zaitsu et al. | |
| 2012/0001770 | A1 | 1/2012 | Oh et al. | |
| 2015/0310739 | A1 | 10/2015 | Beaurepaire et al. | |
| 2016/0063857 | A1* | 3/2016 | Fowe | G01C 21/3492 701/117 |
| 2016/0071411 | A1 | 3/2016 | Stenneth | |
| 2017/0004705 | A1 | 1/2017 | Fowe et al. | |
| 2017/0004707 | A1 | 1/2017 | Fowe et al. | |

OTHER PUBLICATIONS

Muñoz, Juan Carlos, "The Bottleneck Mechanism of a Freeway Diverge", *Transportation Research Part A Policy and Practice*, Dec. 2000, 36 pages, retrieved from <https://www.researchgate.net/publication/222667088> on Sep. 14, 2016.

* cited by examiner

SPLIT LANE TRAFFIC JAM DETECTION AND REMEDIATION

TECHNOLOGICAL FIELD

An example embodiment relates generally to detection and/or remediation of traffic jams associated with an intersection. In particular, an example embodiment generally relates to detecting intersections experiencing and/or causing split lane traffic jams and/or remediation thereof.

BACKGROUND

Traffic conditions may be quite different in different lanes of a multi-lane road. For example, in optimal traffic conditions, a bottleneck at an exit ramp of a highway would not affect the traffic in the left hand lanes of the highway. However, if drivers who wish to exit the highway at the exit ramp try to avoid the bottleneck by traveling in a middle or left hand lane and then attempting to access the exit at the last moment, the bottleneck at the exit ramp becomes a traffic jam that affects several lanes of traffic. Once intersections that experience this type of traffic jam (e.g., a split lane traffic jam) are identified, they can often be remedied. For example, the timing of a traffic light at the end of the exit ramp may be modified to reduce the bottleneck on the exit ramp. However, pin-pointing intersections, such as this example intersection, that tend to experience split lane traffic jams, for example, at split lane intersections is difficult due to the inability to determine the travel lane of a probe vehicle. In particular, location determining systems, such as Global Positioning Systems (GPS), allow for determining the location of a probe vehicle. For example, the road segment along which a probe vehicle is traveling may be determined. However, the error in a GPS position determination is too large for determination of which lane on a road segment the probe vehicle is traveling. For example, the width of many lanes is only three to four meters. However, under good circumstances, GPS provides a location with a 95% confidence interval of 7.8 meters, according to the U.S. government. Thus, the error in a GPS location may be more than twice the width of a lane, making it difficult to determine which lane a probe vehicle is traveling in and difficult to identify intersections, such as split lane intersections, for example, that are experiencing and/or causing split lane traffic jams.

BRIEF SUMMARY OF CERTAIN EXAMPLE EMBODIMENTS

At least some example embodiments are directed to identifying and/or remedying a traffic jam being experienced and/or caused by an intersection. In an example embodiment, probe information/data may be received and clusters of pre-intersection and post-intersection probe information/data may be created based on a road segment that the probe apparatus providing the probe information/data traveled after travelling through the intersection. A traffic level indicator may be determined, computed, and/or generated for each cluster. The traffic level indicators may then be analyzed to determine if the corresponding intersection is experiencing and/or causing a split lane traffic jam. In an example embodiment, steps may be taken to remedy the split lane traffic jam and/or to provide traffic jam notifications that may be used, for example, to recalculate a route or update a travel and/or expected arrival time.

In an example embodiment, a plurality of instances of pre-intersection probe data are received. Each instance is provided by a probe apparatus of a plurality of probe apparatuses. The probe apparatus comprises a plurality of sensors and is on board a vehicle. An instance of the plurality of instances of pre-intersection probe data comprises (a) a probe identifier configured to identify the corresponding probe apparatus and (b) a pre-intersection travel speed at which the corresponding vehicle traveled at least a portion of a pre-intersection road segment. The vehicle traveled the pre-intersection road segment before traveling through an intersection. A plurality of instances of post-intersection probe data is received. Each instance is provided by a probe apparatus of the plurality of probe apparatuses. An instance of the plurality of instances of post-intersection probe data comprises (a) the probe identifier corresponding to the probe apparatus, (b) a post-intersection travel speed at which the corresponding vehicle traveled at least a portion of a post-intersection road segment, and (c) information identifying the post-intersection road segment. The vehicle traveled the post-intersection road segment after traveling through the intersection. Instances of the plurality of instances of pre-intersection probe data are clustered based on the post-intersection road segment corresponding to each instance to generate two or more pre-intersection clusters. Instances of the plurality of instances of post-intersection probe data are clustered based on the post-intersection road segment corresponding to each instance to generate two or more post-intersection clusters. A pre-intersection traffic level indicator is determined for each pre-intersection cluster probe data based on a pre-intersection travel speed for the corresponding pre-intersection cluster. A post-intersection traffic level indicator for each cluster of post-intersection probe data is determined based on a post-intersection speed for the corresponding post-intersection cluster. Responsive to determining that at least one traffic level indicator difference satisfies a threshold requirement, the intersection is identified as experiencing a split lane traffic jam.

In accordance with an example embodiment, a method is provided that comprises receiving a plurality of instances of pre-intersection probe data. Each instance of the plurality of instances of pre-intersection probe data is provided by a probe apparatus of a plurality of probe apparatuses. The probe apparatus comprises a plurality of sensors and is on board a vehicle. An instance of the plurality of instances of pre-intersection probe data comprises (a) a probe identifier configured to identify the corresponding probe apparatus and (b) a pre-intersection travel speed at which the corresponding vehicle traveled at least a portion of a pre-intersection road segment. The vehicle traveled the pre-intersection road segment before traveling through an intersection. The method further comprises receiving a plurality of instances of post-intersection probe data. Each instance of the plurality of instances of post-intersection probe data is provided by a probe apparatus of the plurality of probe apparatuses. An instance of the plurality of instances of post-intersection probe data comprises (a) the probe identifier corresponding to the probe apparatus, (b) a post-intersection travel speed at which the corresponding vehicle traveled at least a portion of a post-intersection road segment, and (c) information identifying the post-intersection road segment. The vehicle traveled the post-intersection road segment after traveling through the intersection. The method further comprises clustering instances of the plurality of instances of pre-intersection probe data based on the post-intersection road segment corresponding to each instance to generate two or more pre-intersection clusters;

and clustering instances of the plurality of instances of post-intersection probe data based on the post-intersection road segment corresponding to each instance to generate two or more post-intersection clusters. The method further comprises determining a pre-intersection traffic level indicator for each pre-intersection cluster probe data based on a pre-intersection travel speed for the corresponding pre-intersection cluster; and determining a post-intersection traffic level indicator for each cluster of post-intersection probe data based on a post-intersection speed for the corresponding post-intersection cluster. The method further comprises responsive to determining that at least one traffic level indicator difference satisfies a threshold requirement, identifying the intersection as experiencing a split lane traffic jam.

In an example embodiment, the pre-intersection road segment is immediately before the intersection. In an example embodiment the post-intersection road segment is immediately following the intersection. In an example embodiment, a traffic level indicator for a road segment is determined by determining a road segment type for the road segment; identifying a road segment type normalization factor for the road segment type; based on the probe data, determining a ratio of average travel speed for the road segment to a free flow speed for the road segment; and applying the road segment type normalization factor to the ratio. In an example embodiment, the traffic jam is a split lane traffic jam. In an example embodiment, in response to receiving an instance of the plurality of instances of post-intersection probe data corresponding to a particular probe apparatus, a direction of travel of the corresponding vehicle is determined based on an instance of pre-intersection probe data comprising a probe identifier identifying the particular probe apparatus and the instance of the plurality of instances of post-intersection probe data. The clustering of the instance of pre-intersection probe data corresponding to the particular probe apparatus is then based at least in part on the direction of travel determined for the particular probe apparatus.

In an example embodiment, a first instance of the plurality of instances of post-intersection probe data comprises a first probe identifier and information identifying a first post-intersection road segment, and based on a first instance of the plurality of instances of pre-intersection probe data comprising the first probe identifier, the first instance of the plurality of instances of pre-intersection probe data is clustered into a first pre-intersection cluster. A second instance of the plurality of instances of post-intersection probe data comprises a second probe identifier and information identifying a second post-intersection road segment, and based on a second instance of the plurality of instances of pre-intersection probe data comprising the second probe identifier, the second instance of the plurality of instances of pre-intersection probe data is clustered into a second pre-intersection cluster. The first post-intersection road segment is different from the second post-intersection road segment and the first pre-intersection cluster is different from the second pre-intersection cluster. In an example embodiment, a first pre-intersection traffic level indicator is determined based on an average first pre-intersection travel speed determined corresponding to the first pre-intersection cluster, and a second pre-intersection traffic level indicator is determined based on an average second pre-intersection travel speed determined corresponding to the second pre-intersection cluster. In an example embodiment, the first instance of the plurality of instances of post-intersection probe data is clustered into a first post-intersection cluster, and the second instance of the plurality of instances of post-intersection probe data is clustered into a second post-intersection cluster. In an example embodiment, a first post-intersection traffic level indicator is determined based on an average first post-intersection travel speed determined corresponding to the first post-intersection cluster, and a second post-intersection traffic level indicator is determined based on an average second post-intersection travel speed determined corresponding to the second post-intersection cluster. In an example embodiment, the method further comprises determining a first travel level indicator difference by determining a difference between the first pre-intersection traffic level indicator and the first post-intersection traffic level indicator; and determining a second travel level indicator difference by determining the difference between the second pre-intersection traffic level indicator and the second post-intersection traffic level indicator.

In an example embodiment, in response to identifying that the intersection is experiencing a traffic jam, a traffic jam notification is provided to a computing entity. In an example embodiment, responsive to receiving the traffic jam notification, the computing entity processes the traffic jam notification and, responsive to the processing, provides a traffic jam alert through a user interface of the computing entity. In an example embodiment, the computing entity comprises at least one of a probe device or a traffic management apparatus. In an example embodiment, in response to receiving the traffic jam notification, the computing entity (a) recalculates a route for traveling from a start location to a destination location or (b) determines an updated arrival or travel time. In an example embodiment, the method further comprises tracking the identifying of the intersection as experiencing a traffic jam; determining, based on the tracking, that the intersection is a problem intersection; and providing a problem intersection traffic jam notification, wherein a computing entity receives the problem intersection traffic jam notification, and, responsive thereto, triggers a modification of the intersection or a nearby intersection.

In accordance with an example embodiment, an apparatus is provided that comprises at least one processor and at least one memory storing computer program code, with the at least one memory and the computer program code configured to, with the processor, cause the apparatus to at least receive a plurality of instances of pre-intersection probe data. Each instance of the plurality of instances of pre-intersection probe data is provided by a probe apparatus of a plurality of probe apparatuses. The probe apparatus comprises a plurality of sensors and is on board a vehicle. An instance of the plurality of instances of pre-intersection probe data comprises (a) a probe identifier configured to identify the corresponding probe apparatus and (b) a pre-intersection travel speed at which the corresponding vehicle traveled at least a portion of a pre-intersection road segment. The vehicle traveled the pre-intersection road segment before traveling through an intersection. The at least one memory and the computer program code are further configured to, with the processor, cause the apparatus to receive a plurality of instances of post-intersection probe data. Each instance of the plurality of instances of post-intersection probe data being provided by a probe apparatus of the plurality of probe apparatuses. An instance of the plurality of instances of post-intersection probe data comprises (a) the probe identifier corresponding to the probe apparatus, (b) a post-intersection travel speed at which the corresponding vehicle traveled at least a portion of a post-intersection road segment, and (c) information identifying the post-intersection road segment. The vehicle traveled the post-intersection road segment after traveling through the intersection. The at least one memory and the computer program code are further configured to, with the processor, cause the apparatus to cluster instances of the plurality of instances of pre-intersection probe data based on the post-intersection road segment corresponding to each instance to generate two or more pre-intersection clusters; and cluster instances of the plurality of instances of post-intersection probe data based on the post-intersection road segment corresponding to each instance to generate two or more post-intersection clusters. The at least one memory and the computer program code are further configured to, with the processor, cause the apparatus to determine a pre-intersection traffic level indicator for each pre-intersection cluster probe data based on a pre-intersection travel speed for the corresponding pre-intersection cluster; and determine a post-intersection traffic level indicator for each cluster of post-intersection probe data based on a post-intersection speed for the corresponding post-intersection cluster. The at least one memory and the computer program code are further configured to, with the processor, cause the apparatus to responsive to determining that at least one traffic level indicator difference satisifies a threshold requirement, identify the intersection as experiencing a split lane traffic jam.

In an example embodiment, the pre-intersection road segment is immediately before the intersection. In an example embodiment the post-intersection road segment is immediately following the intersection. In an example embodiment, the at least one memory and the computer program code are configured to, with the processor, cause the apparatus to determine a traffic level indicator for a road segment by determining a road segment type for the road segment; identifying a road segment type normalization factor for the road segment type; based on the probe data, determining a ratio of average travel speed for the road segment to a free flow speed for the road segment; and applying the road segment type normalization factor to the ratio. In an example embodiment, the traffic jam is a split lane traffic jam. In an example embodiment, in response to receiving an instance of the plurality of instances of post-intersection probe data corresponding to a particular probe apparatus, a direction of travel of the corresponding vehicle is determined based on an instance of pre-intersection probe data comprising a probe identifier identifying the particular probe apparatus and the instance of the plurality of instances of post-intersection probe data. The clustering of the instance of pre-intersection probe data corresponding to the particular probe apparatus is then based at least in part on the direction of travel determined for the particular probe apparatus.

In an example embodiment, a first instance of the plurality of instances of post-intersection probe data comprises a first probe identifier and information identifying a first post-intersection road segment, and based on a first instance of the plurality of instances of pre-intersection probe data comprising the first probe identifier, the first instance of the plurality of instances of pre-intersection probe data is clustered into a first pre-intersection cluster. A second instance of the plurality of instances of post-intersection probe data comprises a second probe identifier and information identifying a second post-intersection road segment, and based on a second instance of the plurality of instances of pre-intersection probe data comprising the second probe identifier, the second instance of the plurality of instances of pre-intersection probe data is clustered into a second pre-intersection cluster. The first post-intersection road segment is different from the second post-intersection road segment and the first pre-intersection cluster is different from the second pre-intersection cluster. In an example embodiment, a first pre-intersection traffic level indicator is determined based on an average first pre-intersection travel speed determined corresponding to the first pre-intersection cluster, and a second pre-intersection traffic level indicator is determined based on an average second pre-intersection travel speed determined corresponding to the second pre-intersection cluster. In an example embodiment, the first instance of the plurality of instances of post-intersection probe data is clustered into a first post-intersection cluster, and the second instance of the plurality of instances of post-intersection probe data is clustered into a second post-intersection cluster. In an example embodiment, a first post-intersection traffic level indicator is determined based on an average first post-intersection travel speed determined corresponding to the first post-intersection cluster, and a second post-intersection traffic level indicator is determined based on an average second post-intersection travel speed determined corresponding to the second post-intersection cluster. In an example embodiment, the at least one memory and the computer program code are further configured to, with the processor, cause the apparatus to determine a first travel level indicator difference by determining a difference between the first pre-intersection traffic level indicator and the first post-intersection traffic level indicator; and determine a second travel level indicator difference by determining the difference between the second pre-intersection traffic level indicator and the second post-intersection traffic level indicator.

In an example embodiment, in response to identifying that the intersection is experiencing a traffic jam, a traffic jam notification is provided to a computing entity. In an example embodiment, responsive to receiving the traffic jam notification, the computing entity processes the traffic jam notification and, responsive to the processing, provides a traffic jam alert through a user interface of the computing entity. In an example embodiment, the computing entity comprises at least one of a probe device or a traffic management apparatus. In an example embodiment, in response to receiving the traffic jam notification, the computing entity (a) recalculates a route for traveling from a start location to a destination location or (b) determines an updated arrival or travel time. In an example embodiment, the at least one memory and the computer program code are further configured to, with the processor, cause the apparatus to track the identifying of the intersection as experiencing a traffic jam; determine, based on the tracking, that the intersection is a problem intersection; and provide a problem intersection traffic jam notification, wherein a computing entity receives the problem intersection traffic jam notification, and, responsive thereto, triggers a modification of the intersection or a nearby intersection.

In accordance with an example embodiment, a computer program product is provided that comprises at least one non-transitory computer-readable storage medium having computer-executable program code instructions stored therein with the computer-executable program code instructions comprising program code instructions configured to receive a plurality of instances of pre-intersection probe data. Each instance of the plurality of instances of pre-intersection probe data is provided by a probe apparatus of a plurality of probe apparatuses. The probe apparatus comprises a plurality of sensors and is on board a vehicle. An instance of the plurality of instances of pre-intersection probe data comprises (a) a probe identifier configured to identify the corresponding probe apparatus and (b) a pre-intersection travel speed at which the corresponding vehicle traveled at least a portion of a pre-intersection road segment. The vehicle traveled the pre-intersection road segment before traveling through an intersection. The computer-executable program code instructions further comprise program code instructions configured to receive a plurality of instances of post-intersection probe data. Each instance of the plurality of instances of post-intersection probe data is provided by a probe apparatus of the plurality of probe apparatuses. An instance of the plurality of instances of post-intersection probe data comprises (a) the probe identifier corresponding to the probe apparatus, (b) a post-intersection travel speed at which the corresponding vehicle traveled at least a portion of a post-intersection road segment, and (c) information identifying the post-intersection road segment. The vehicle traveled the post-intersection road segment after traveling through the intersection. The computer-executable program code instructions further comprise program code instructions configured to cluster instances of the plurality of instances of pre-intersection probe data based on the post-intersection road segment corresponding to each instance to generate two or more pre-intersection clusters; and cluster instances of the plurality of instances of post-intersection probe data based on the post-intersection road segment corresponding to each instance to generate two or more post-intersection clusters. The computer-executable program code instructions further comprise program code instructions configured to determine a pre-intersection traffic level indicator for each pre-intersection cluster probe data based on a pre-intersection travel speed for the corresponding pre-intersection cluster; and determine a post-intersection traffic level indicator for each cluster of post-intersection probe data based on a post-intersection speed for the corresponding post-intersection cluster. The computer-executable program code instructions further comprise program code instructions configured to, responsive to determining that at least one traffic level indicator difference satisfies a threshold requirement, identify the intersection as experiencing a split lane traffic jam.

In an example embodiment, the pre-intersection road segment is immediately before the intersection. In an example embodiment the post-intersection road segment is immediately following the intersection. In an example embodiment, the computer-executable program code instructions further comprise program code instructions configured to determine a traffic level indicator for a road segment by determining a road segment type for the road segment; identifying a road segment type normalization factor for the road segment type; based on the probe data, determining a ratio of average travel speed for the road segment to a free flow speed for the road segment; and applying the road segment type normalization factor to the ratio. In an example embodiment, the traffic jam is a split lane traffic jam. In an example embodiment, in response to receiving an instance of the plurality of instances of post-intersection probe data corresponding to a particular probe apparatus, a direction of travel of the corresponding vehicle is determined based on an instance of pre-intersection probe data comprising a probe identifier identifying the particular probe apparatus and the instance of the plurality of instances of post-intersection probe data. The clustering of the instance of pre-intersection probe data corresponding to the particular probe apparatus is then based at least in part on the direction of travel determined for the particular probe apparatus.

In an example embodiment, a first instance of the plurality of instances of post-intersection probe data comprises a first probe identifier and information identifying a first post-intersection road segment, and based on a first instance of the plurality of instances of pre-intersection probe data comprising the first probe identifier, the first instance of the plurality of instances of pre-intersection probe data is clustered into a first pre-intersection cluster. A second instance of the plurality of instances of post-intersection probe data comprises a second probe identifier and information identifying a second post-intersection road segment, and based on a second instance of the plurality of instances of pre-intersection probe data comprising the second probe identifier, the second instance of the plurality of instances of pre-intersection probe data is clustered into a second pre-intersection cluster. The first post-intersection road segment is different from the second post-intersection road segment and the first pre-intersection cluster is different from the second pre-intersection cluster. In an example embodiment, a first pre-intersection traffic level indicator is determined based on an average first pre-intersection travel speed determined corresponding to the first pre-intersection cluster, and a second pre-intersection traffic level indicator is determined based on an average second pre-intersection travel speed determined corresponding to the second pre-intersection cluster. In an example embodiment, the first instance of the plurality of instances of post-intersection probe data is clustered into a first post-intersection cluster, and the second instance of the plurality of instances of post-intersection probe data is clustered into a second post-intersection cluster. In an example embodiment, a first post-intersection traffic level indicator is determined based on an average first post-intersection travel speed determined corresponding to the first post-intersection cluster, and a second post-intersection traffic level indicator is determined based on an average second post-intersection travel speed determined corresponding to the second post-intersection cluster. In an example embodiment, the computer-executable program code instructions further comprise program code instructions configured to determine a first travel level indicator difference by determining a difference between the first pre-intersection traffic level indicator and the first post-intersection traffic level indicator; and determine a second travel level indicator difference by determining the difference between the second pre-intersection traffic level indicator and the second post-intersection traffic level indicator.

In an example embodiment, in response to identifying that the intersection is experiencing a traffic jam, a traffic jam notification is provided to a computing entity. In an example embodiment, responsive to receiving the traffic jam notification, the computing entity processes the traffic jam notification and, responsive to the processing, provides a traffic jam alert through a user interface of the computing entity. In an example embodiment, the computing entity comprises at least one of a probe device or a traffic management apparatus. In an example embodiment, in response to receiving the traffic jam notification, the computing entity (a) recalculates a route for traveling from a start location to a destination location or (b) determines an updated arrival or travel time. In an example embodiment, the computer-executable program code instructions further comprise program code instructions configured to track the identifying of the intersection as experiencing a traffic jam; determine, based on the tracking, that the intersection is a problem intersection; and provide a problem intersection traffic jam notification, wherein a computing entity receives the problem intersection traffic jam notification, and, responsive thereto, triggers a modification of the intersection or a nearby intersection.

In accordance with yet another example embodiment of the present invention, an apparatus is provided that comprises means for receiving a plurality of instances of pre-intersection probe data. Each instance of the plurality of instances of pre-intersection probe data is provided by a probe apparatus of a plurality of probe apparatuses. The probe apparatus comprises a plurality of sensors and is on board a vehicle. An instance of the plurality of instances of pre-intersection probe data comprises (a) a probe identifier configured to identify the corresponding probe apparatus and (b) a pre-intersection travel speed at which the corresponding vehicle traveled at least a portion of a pre-intersection road segment. The vehicle traveled the pre-intersection road segment before traveling through an intersection. The apparatus comprises means for receiving a plurality of instances of post-intersection probe data. Each instance of the plurality of instances of post-intersection probe data is provided by a probe apparatus of the plurality of probe apparatuses. An instance of the plurality of instances of post-intersection probe data comprises (a) the probe identifier corresponding to the probe apparatus, (b) a post-intersection travel speed at which the corresponding vehicle traveled at least a portion of a post-intersection road segment, and (c) information identifying the post-intersection road segment. The vehicle traveled the post-intersection road segment after traveling through the intersection. The apparatus comprises means for clustering instances of the plurality of instances of pre-intersection probe data based on the post-intersection road segment corresponding to each instance to generate two or more pre-intersection clusters; and means for clustering instances of the plurality of instances of post-intersection probe data based on the post-intersection road segment corresponding to each instance to generate two or more post-intersection clusters. The apparatus comprises means for determining a pre-intersection traffic level indicator for each pre-intersection cluster probe data based on a pre-intersection travel speed for the corresponding pre-intersection cluster; and means for determining a post-intersection traffic level indicator for each cluster of post-intersection probe data based on a post-intersection speed for the corresponding post-intersection cluster. The apparatus comprises means, responsive to determining that at least one traffic level indicator difference satisfies a threshold requirement, for identifying the intersection as experiencing a split lane traffic jam.

BRIEF DESCRIPTION OF THE DRAWINGS

Figure 1:
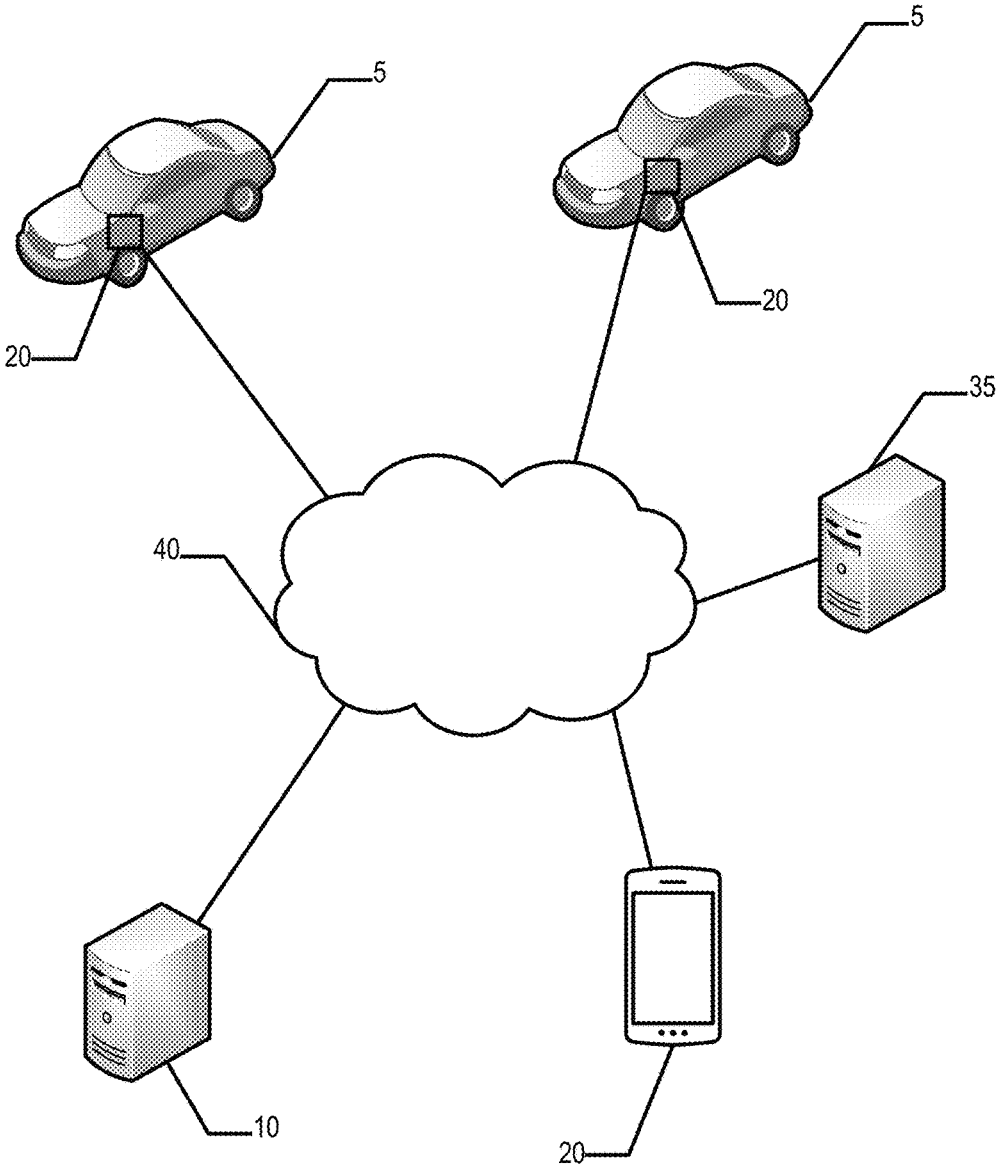
Figure 2A:
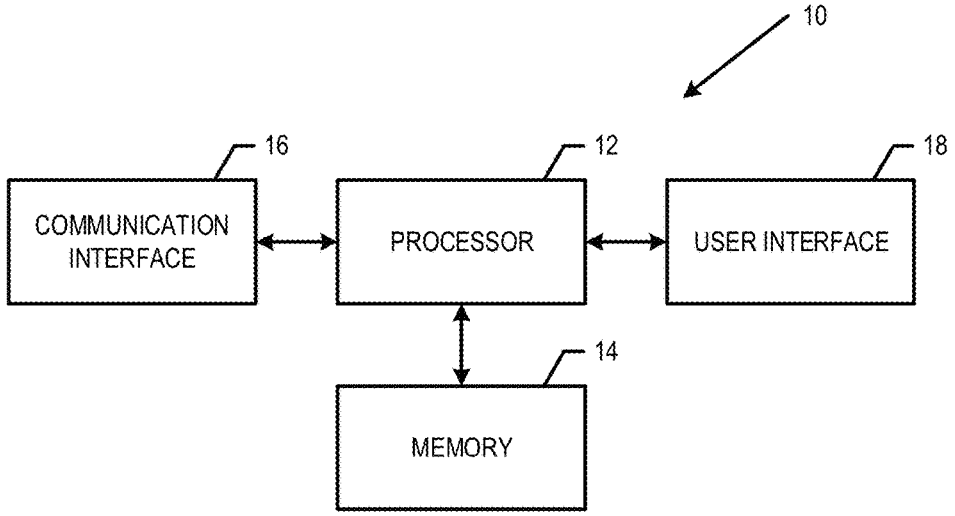
Figure 2B:
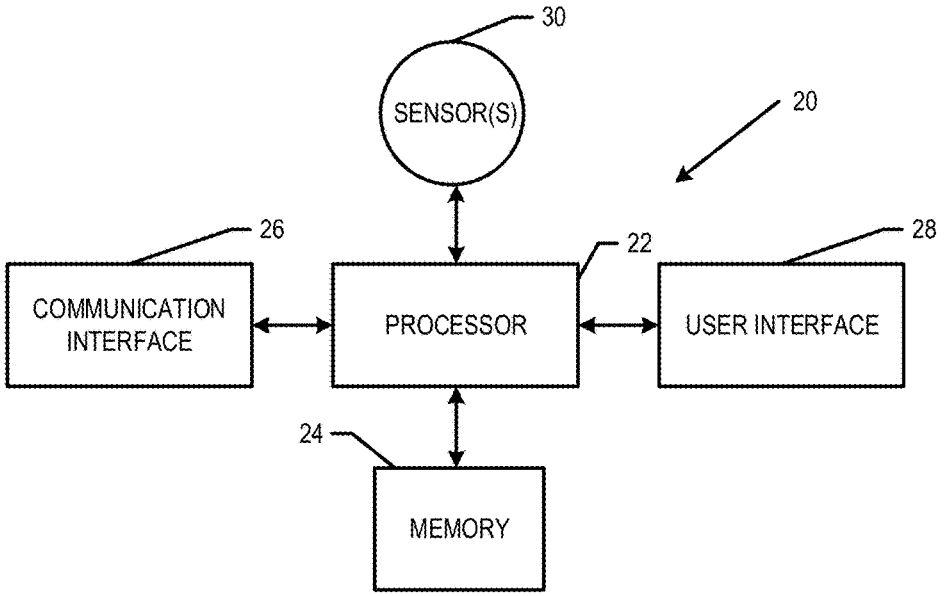
Figure 3:
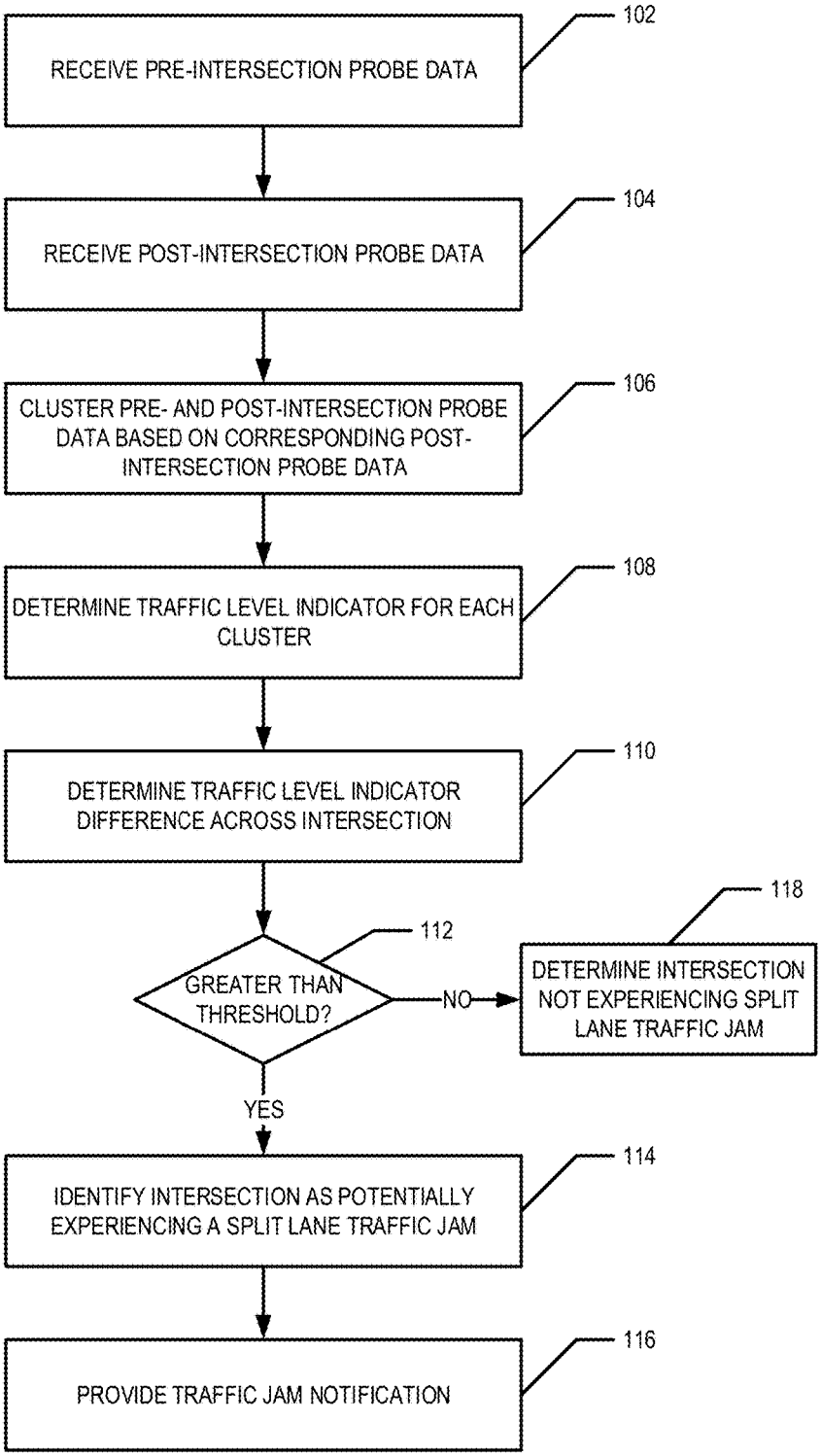
Figure 4B:
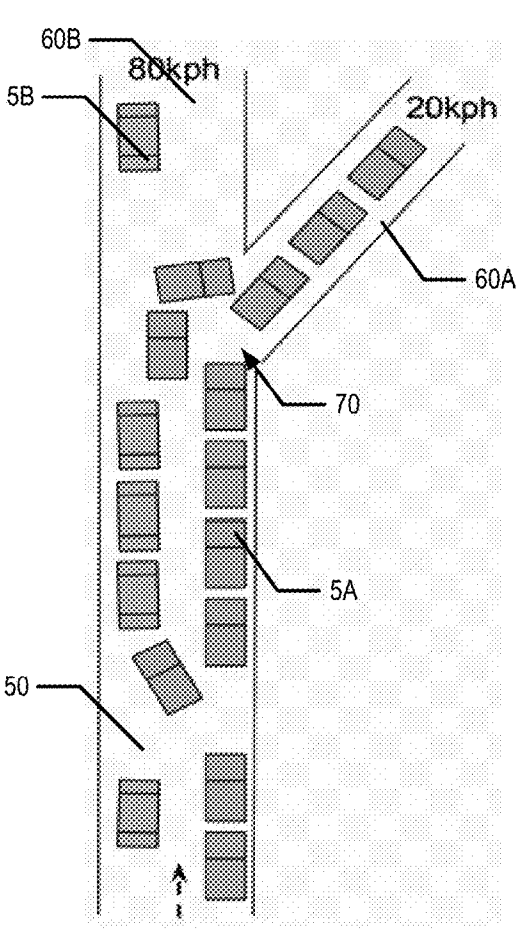
Figure 4A:
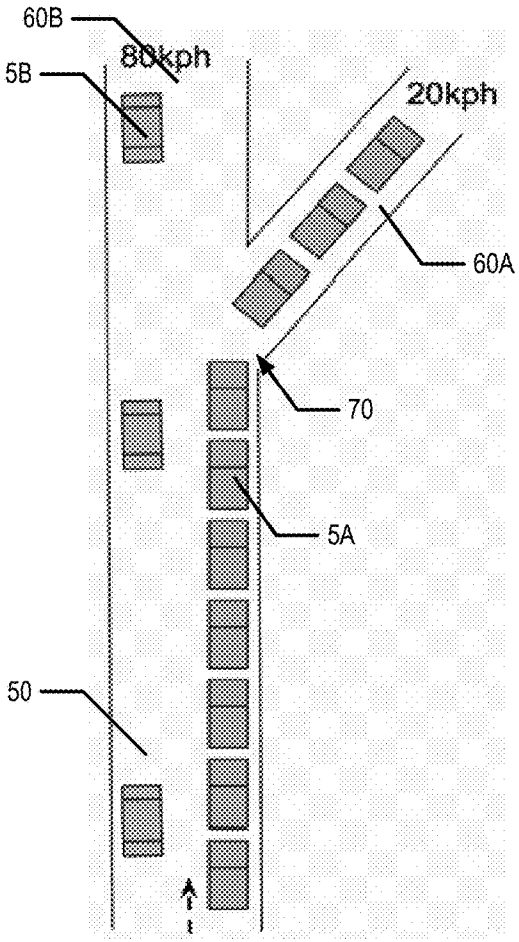
Figure 5A:
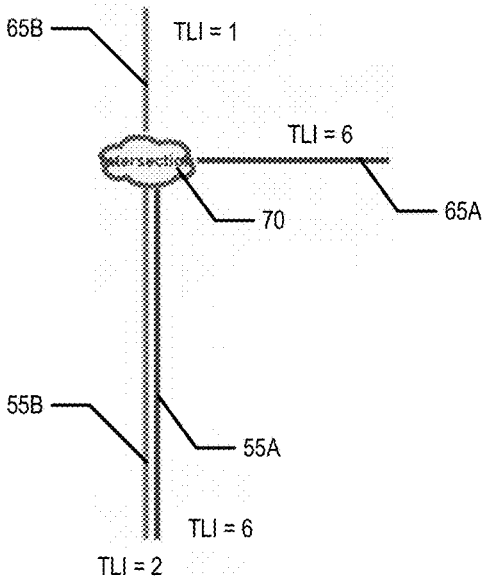
Figure 5B:
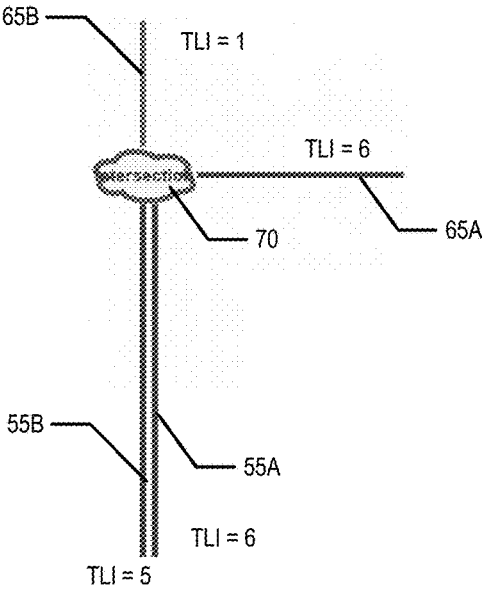

Having thus described certain example embodiments in general terms, reference will hereinafter be made to the accompanying drawings, which are not necessarily drawn to scale, and wherein:

FIG. 1 is a block diagram showing an example architecture of one embodiment of the present invention;

FIG. 2A is a block diagram of an apparatus that may be specifically configured in accordance with an example embodiment;

FIG. 2B is a block diagram of a probe apparatus that may be specifically configured in accordance with an example embodiment;

FIG. 3 is a flowchart illustrating operations performed, such as by the apparatus of FIG. 2A to identify and remedy a split lane traffic jam, in accordance with an example embodiment;

FIG. 4A is a diagram of an example intersection that is not experiencing a split lane traffic jam, in accordance with an example embodiment;

FIG. 4B is a diagram of an example intersection that is experiencing a split lane traffic jam, in accordance with an example embodiment;

FIG. 5A is a diagram illustrating the traffic level indicators (TLIs) for the intersection shown in FIG. 4A, in accordance with an example embodiment; and FIG. 5B is a diagram illustrating the TLIs for the intersection shown in FIG. 4B, in accordance with an example embodiment.

DETAILED DESCRIPTION OF SOME EXAMPLE EMBODIMENTS

Some embodiments will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout. As used herein, the terms "data," "content," "information," and similar terms may be used interchangeably to refer to data capable of being transmitted, received and/or stored in accordance with embodiments of the present invention. Thus, use of any such terms should not be taken to limit the spirit and scope of embodiments of the present invention.

I. General Overview

Methods, apparatus and computer program products are provided in accordance with an example embodiment in order to identify intersections experiencing and/or causing split lane traffic jams in real time or near real time. In an example embodiment, a split lane traffic jam is a traffic jam that is caused by a bottleneck that affects a post-intersection road segment causing one or more lanes of a pre-intersection road segment that are not affiliated with the post-intersection road segment to experience a traffic jam. In an example embodiment, a split lane traffic jam is a traffic jam that impacts one or more lanes of traffic along a road segment by causing traffic along the road segment to slow or stop, while one or more other lanes of traffic along the same road segment are not caused to slow or stop, at least not to the same degree. Thus, a split lane traffic jam impacts some, but not all lanes of a road segment, thereby resulting in a differential in the driving experience depending upon the lane along which a vehicle travels. Split lane traffic jams may occur at any of a variety of intersections, such as at lighted intersections in which the left turn lane of a road segment may create a split lane traffic jam condition causing the straight lanes move at reduced speed. Alternatively, a split lane traffic jam may be caused by a bottleneck at a highway exit ramp causing one or more middle or left lanes of the highway approaching the intersection (e.g., exit) to experience a traffic jam.

In an example embodiment, pre-intersection probe information/data may be received from probe apparatuses traveling on board vehicles that are approaching an intersection. After the probe apparatuses and their corresponding vehicles have traveled through the intersection, post-intersection probe information/data may be received from the probe apparatuses. The pre-intersection probe data may be clustered based on how the probe apparatus that provided the probe data traveled through the intersection. For example, the pre-intersection probe data provided by probe apparatus A may comprise a probe identifier identifying the probe apparatus A. After probe apparatus A travels through the intersection, post-intersection probe data identifying the probe apparatus A and indicating how the probe apparatus A traveled through the intersection is provided. Thus, the pre-intersection probe data provided by probe apparatus A may be identified (e.g., based on the probe identifier and/or the like) and associated with how the probe apparatus A traveled through the intersection. The probe data provided by probe apparatus A may then be clustered based on how the probe apparatus A traveled through the intersection. It may then be determined if a cluster of probe data indicates that the corresponding vehicles traveling through the intersection were experiencing a traffic jam before the intersection. If the cluster of probe data indicates that the corresponding vehicles were experiencing a traffic jam before the intersection but were not experiencing a traffic jam after traveling through the intersection, it may be determined that the traffic jam was caused by and/or associated with the intersection. After a traffic jam being experienced by and/or caused by an intersection is identified, drivers experiencing the traffic jam may be alerted, expected travel and/or arrival times may be updated, traffic management apparatuses may be notified, and/or the like. If it is determined that a particular intersection is prone to experiencing and/or causing traffic jams, the particular intersection may be flagged for review and/or remediation.

FIG. 1 provides an illustration of an example system that can be used in conjunction with various embodiments of the present invention. As shown in FIG. 1, the system may include a plurality of probe apparatuses 20, one or more apparatuses 10, one or more other computing entities 35, one or more networks 40, and/or the like. In various embodiments, the probe apparatus 20 may be an in vehicle navigation system, vehicle control system, a mobile computing device, and/or the like. For example, a probe apparatus 20 may be an in vehicle navigation system mounted within and/or be on-board a vehicle 5 such as a motor vehicle, non-motor vehicle, automobile, car, scooter, truck, van, bus, motorcycle, bicycle, Segway, golf cart, and/or the like. In various embodiments, the probe apparatus 20 may be a smartphone, tablet, personal digital assistant (PDA), and/or other mobile computing device. In another example, the probe apparatus 20 may be a vehicle control system configured to autonomously drive a vehicle 5, assist in control of a vehicle 5, and/or the like. In example embodiments, a probe apparatus 20 is on board a dedicated probe vehicle. In some embodiments, a probe apparatus 20 may be on board a personal vehicle, commercial vehicle, public transportation vehicle, and/or other vehicle. In an example embodiment, a probe apparatus 20 is any apparatus that provides (e.g., transmits) probe information/data (e.g., pre- and/or post-intersection probe information/data) to the apparatus 10.

In an example embodiment, an apparatus 10 may comprise components similar to those shown in the example apparatus 10 diagrammed in FIG. 2A. In an example embodiment, the apparatus 10 is configured to provide map updates, reference image information/data, traffic jam notifications, problem intersection traffic jam notifications, and/or the like to the probe apparatus 20 and/or computing entity 35. In an example embodiment, a probe apparatus 20 may comprise components similar to those shown in the example probe apparatus 20 diagrammed in FIG. 2B. In various embodiments, the apparatus 10 may be located remotely from the probe apparatus 20. Each of the components of the system may be in electronic communication with, for example, one another over the same or different wireless or wired networks 40 including, for example, a wired or wireless Personal Area Network (PAN), Local Area Network (LAN), Metropolitan Area Network (MAN), Wide Area Network (WAN), cellular network, and/or the like. In some embodiments, a network 40 may comprise the automotive cloud, digital transportation infrastructure (DTI), radio data system (RDS)/high definition (HD) radio or other digital radio system, and/or the like. For example, a probe apparatus 20 may be in communication with an apparatus 10 via the network 40. For example, the probe apparatus 20 may communicate with the apparatus 10 via a network, such as the Cloud. For example, the Cloud may be a computer network that provides shared computer processing resources and data to computers and other devices connected thereto. For example, the probe apparatus 20 may be configured to receive one or more map tiles of a digital map from the apparatus 10 and/or provide probe information/data to the apparatus 10.

In an example embodiment, as shown in FIG. 2B, the probe apparatus 20 may comprise a processor 22, memory 24, a communications interface 26, a user interface 28, one or more sensors 30 (e.g., a location sensor such as a GPS sensor; IMU sensors; camera(s); two dimensional (2D) and/or three dimensional (3D) light detection and ranging (LiDAR)(s); long, medium, and/or short range radio detection and ranging (RADAR); ultrasonic sensors; electromagnetic sensors; (near-) infrared (IR) cameras; 3D cameras; 360° cameras; and/or other sensors that enable the probe apparatus 20 to determine one or more features of the corresponding vehicle's 5 surroundings), and/or other components configured to perform various operations, procedures, functions or the like described herein. In at least some example embodiments, the memory 24 is non-transitory.

Similarly, as shown in FIG. 2A, the apparatus 10 may comprise a processor 12, memory 14, a user interface 18, a communications interface 16, and/or other components configured to perform various operations, procedures, functions or the like described herein. In at least some example embodiments, the memory 14 is non-transitory. The computing entity 35 may comprise similar elements to the apparatus 10 or the probe apparatus 20. For example, the computing entity 35 may comprise a processor, memory, a user interface, a communications interface, and/or the like. In an example embodiment, the computing entity 35 may comprise one or more sensors similar to sensor(s) 30. Certain example embodiments of the probe apparatus 20 and the apparatus 10 are described in more detail below with respect to FIGS. 2A and 2B.

II. Example Operation

In at least some example embodiments, pre-intersection and post-intersection probe information/data may be analyzed to determine if a particular intersection is experiencing and/or causing a split lane traffic jam. For example, an intersection may be a node where three or more road segments meet. For example, a vehicle may approach an intersection by traveling along an incoming road segment. The vehicle may then exit the intersection along an outgoing road segment. Two or more outgoing road segments may exist for an example intersection. In an example embodiment, the intersection is a split lane intersection. However, aspects of various embodiments may be used to identify and/or remedy traffic jams at various types of intersections.

In an example embodiment, a probe apparatus 20 may provide (e.g., transmit) pre-intersection probe information/data to an apparatus 10. The pre-intersection probe information/data may comprise at least one of a probe identifier configured to identify the probe apparatus 20, a pre-intersection link identifier configured to identify the digital map link representing the road segment the probe apparatus 20 is travelling along, a pre-intersection location such as a geophysical location of the probe apparatus 20 (e.g., determined by a location sensor 30), a pre-intersection travel speed of the probe apparatus 20 and/or the corresponding vehicle 5 travelling along at least a portion of the pre-intersection road segment, and/or the like. In an example embodiment, the pre-intersection travel speed may be an instantaneous travel speed, an average travel speed over a short time interval (e.g., 10 seconds, 30 seconds, one minute, and/or the like), an average speed over a short distance interval (e.g., along the length of road segment, along a portion of the pre-intersection road segment, and/or the like). In an example embodiment, the pre-intersection travel speed may be determined by one or more sensors 30 (e.g., GPS, IMU, and/or the like), by the vehicle's 5 speedometer, and/or the like.

After the probe apparatus 20, and the corresponding vehicle 5, pass through the intersection, the probe apparatus may provide (e.g., transmit) post-intersection information/data to the apparatus 10. The post-intersection probe information/data may comprise at least one of the probe identifier configured to identify the probe apparatus 20, a post-intersection link identifier configured to identify the digital map link representing the post-intersection road segment the probe apparatus 20 is travelling along, a post-intersection location such as a geophysical location of the probe apparatus 20 (e.g., determined by a location sensor 30), a post-intersection travel speed of the probe apparatus 20 and/or the corresponding vehicle 5 along at least a portion of the post-intersection road segment, and/or the like. In an example embodiment, the post-intersection travel speed may be an instantaneous travel speed, an average travel speed over a short time interval (e.g., 10 seconds, 30 seconds, one minute, and/or the like), an average speed over a short distance interval (e.g., along the length of road segment, along a portion of the post-intersection road segment, and/or the like). In an example embodiment, the post-intersection travel speed may be determined by one or more sensors 30 (e.g., GPS, IMU, and/or the like), by the vehicle's 5 speedometer, and/or the like.

The apparatus 10 may receive instances of pre-intersection probe information/data and instances of post-intersection probe information/data from a plurality of probe apparatuses 20. Thus, the apparatus 10 may receive a plurality of instances of pre-intersection probe information/data, with each instance being provided by a particular probe apparatus 20 of the plurality of probe apparatuses 20. The apparatus 10 may also receive a plurality of instances of post-intersection probe information/data, with each instance being provided by a particular probe apparatus 20 of the plurality of probe apparatuses 20. Each instance of pre-intersection probe information/data may comprise a probe identifier identifying the probe apparatus 20 that captured and provided the pre-intersection probe information/data. Each set of post-intersection probe information/data may comprise a probe identifier identifying the probe apparatus 20 that captured and provided the post-intersection probe information/data. Thus, by using the probe identifier, the apparatus 10 can match an instance of pre-intersection probe information/data to a corresponding instance of post-intersection probe information/data that was provided by the same probe apparatus 20. In an example embodiment, the pre-intersection probe information/data may be captured while the probe apparatus 20 and/or vehicle 5 travels the road segment immediately preceding the intersection. For example, the pre-intersection road segment may be a road segment immediately preceding the intersection.

The post-intersection probe information/data comprises information/data that may be used to determine how the corresponding probe apparatus 20 (e.g., the vehicle 5) traveled through the intersection. For example, the post-intersection probe information/data may comprise a post-intersection link identifier, a post-intersection location, and/or the like that may be used to determine whether the vehicle 5 took a right at the intersection, a left at the intersection, or continued through the intersection. In another example, an intersection may be a highway exit or the like and the post-intersection probe information/data may comprise a post-intersection link identifier, a post-intersection location, and/or the like that may be used to determine whether the vehicle 5 took the exit or continued along the highway. The instance of pre-intersection probe data corresponding to a particular probe apparatus 20 and/or vehicle 5 may then be identified, based on the probe identifier, and added to a particular pre-intersection cluster comprising instances of pre-intersection probe information/data corresponding to probe apparatuses 20 and/or vehicles 5 that traveled through the intersection in the same particular way (e.g., turned left, turned right, continued through the intersection, took the exit, did not take the exit, and/or the like) as the particular probe apparatus 20 and/or vehicle 5. The instance of post-intersection probe data corresponding to the particular probe apparatus 20 and/or vehicle 5 may be added to a particular post-intersection cluster comprising instances of post-intersection probe information/data corresponding to probe apparatuses 20 and/or vehicles 5 that traveled through the intersection in the same particular way (e.g., turned left, turned right, continued through the intersection, took the exit, did not take the exit, and/or the like) as the particular probe apparatus 20 and/or vehicle 5. In an example embodiment, the post-intersection probe information/data may be captured while the probe apparatus 20 and/or vehicle 5 travels the road segment immediately following the intersection. For example, the post-intersection road segment may be immediately after the intersection.

As the pre-intersection probe information/data and the post-intersection probe information/data are separately clustered based on how the corresponding probe apparatus 20 and/or vehicle 5 traveled through the intersection, there will be as many pre-intersection clusters as there are ways to travel through the intersection and as many post-intersection clusters as there are ways to travel through the intersection. For example, if, at a particular intersection, a vehicle may travel through the intersection by taking a right, taking a left, or continuing through the intersection, there will be three (e.g., right, left, and through) pre-intersection clusters and three (e.g., right, left, and through) post-intersection clusters. In another example, if the intersection in question is a simple highway exit, a vehicle may travel through the intersection by exiting or not exiting. In this example there will be two (e.g., exited, did not exit) pre-intersection clusters and two (e.g., exited, did not exit) post-intersection clusters. It should be noted that in some scenarios, a highway intersection may include multiple exits in close proximity (e.g., a right and left exit that located within a kilometer of each other, multiple right exits located within a kilometer of each, and/or the like).

Each pre-intersection cluster and each post-intersection cluster may be independently analyzed to determine a traffic level indicator (TLI) for the corresponding cluster. For example, the travel speeds of the instances of probe information/data in a cluster may be analyzed to determine a TLI for the cluster. In an example embodiment, the TLI may be normalized based on road segment type, classification, time of day, day of the week, weather conditions, and/or the like. The TLI for a pre-intersection cluster may be compared to the TLI for the corresponding post-intersection cluster to determine if a significant difference exists between the pre-intersection traffic level and the post-intersection traffic level. For example, the did not exit pre-intersection TLI (determined based on analyzing probe information/data from the did not exit pre-intersection cluster) may be compared to the did not exit post-intersection TLI (determined based on analyzing probe information/data from the did not exit post-intersection cluster). Similarly, the exited pre-intersection TLI (determined based on analyzing probe information/data from the exited pre-intersection cluster) may be compared to the exited post-intersection TLI (determined based on analyzing probe information/data from the exited post-intersection cluster). If the difference between the pre-intersection TLI and the corresponding post-intersection TLI is greater than a threshold difference, it may be determined that the corresponding intersection is causing and/or experiencing a split lane traffic jam.

After and/or responsive to determining that an intersection is causing and/or experiencing a split lane traffic jam, a traffic jam notification comprising information/data relating to the intersection and/or the corresponding split lane traffic jam may be provided to one or more computing entities 35. For example, a computing entity 35 may be a probe apparatus 20 (e.g., corresponding to a vehicle 5 that is approaching the intersection and/or expected to travel through the intersection on a current trip or an expected trip, and/or the like) or a traffic management apparatus. For example, the computing entity 35 may be a traffic management apparatus that is operated by and/or on behalf of a traffic management agency (e.g., a local department of transportation, city traffic management office, and/or the like). In an example embodiment, the traffic jam notification may comprise computer-executable code and/or reference computer-executable code that, when executed by the computing entity 35 may cause the computing entity 35 to provide a traffic jam alert through a user interface thereof (e.g., a display, audible alert, and/or the like). In an example embodiment, the computing entity 35 may, responsive to receiving the traffic jam notification and/or in response to executing the computer-executable therein and/or referenced thereby, perform one or more route planning computations, determinations, and/or the like. For example, a route planning computation, determination, and/or the like may comprise re-calculating a route, determining an updated travel and/or expected arrival time, and/or the like.

In some embodiments, the apparatus 10 may track intersections identified as experiencing and/or causing split lane traffic jams. For example, if a particular intersection tends to be experiencing a split lane traffic jam, the apparatus 10 may provide a problem intersection traffic jam notification to a computing entity 35 corresponding to a traffic management agency that identifies the particular intersection as a problem intersection. The traffic jam notification that a particular intersection is a problem intersection may trigger action on the part of the traffic management agency to remedy the split lane traffic jams experienced and/or caused by the particular intersection. For example, the timing of a traffic light corresponding to the intersection or at the end of an exit ramp corresponding to the intersection may be updated, the intersection or a nearby intersection (e.g., intersection located at the end of an exit ramp) may be modified and/or the like to remedy the problem intersection status of the particular intersection.

FIG. 3 provides a flowchart illustrating processes and procedures for identifying an intersection experiencing a traffic jam and/or remedying the traffic jam, in accordance with various embodiments. FIGS. 4A and 4B show two example scenarios of an intersection 70. In particular, in FIG. 4A, the intersection 70 is not experiencing a split lane traffic jam and, in FIG. 4B, the intersection 70 is experiencing a split lane traffic jam. For example, the traffic jam shown in FIG. 4A only affects the exit lane. In contrast, the traffic jam shown in FIG. 4B affects both lanes, despite the left lane not being associated with the post-intersection road segment experiencing the bottleneck. The pre-intersection road segment 50 precedes the intersection 70 and post-intersection road segments 60A and 60B follow the intersection 70. For example, a vehicle may travel along the pre-intersection road segment 50, then travel through the intersection, and then travel along one of the post-intersection road segments 60A, 60B.

Starting a block 102 of FIG. 3, pre-intersection probe information/data is received. For example, the apparatus 10 may receive pre-intersection probe information/data. For example, the apparatus 10 may comprise means, such as processor 12, memory 14, communication interface 16, and/or the like, for receiving pre-intersection probe information/data. In an example embodiment, the apparatus 10 may receive a plurality of instances of pre-intersection probe information/data from a plurality of probe apparatuses 20 traveling along a road segment preceding the intersection. In an example embodiment, the probe apparatus 20 may provide pre-intersection probe information/data corresponding to traveling along the pre-intersection road segment 50. In an example embodiment, the pre-intersection road segment 50 immediately precedes the intersection 70. For example, one end of the pre-intersection road segment 50 may abut the intersection 70. In another example, the pre-intersection road segment 50 may terminate at the intersection 70.

In an example embodiment, an instance of pre-intersection probe information/data may comprise at least one of a probe identifier configured to identify the probe apparatus 20 capturing and/or providing the pre-intersection probe information/data, a pre-intersection link identifier configured to identify the link representing the road segment the probe apparatus 20 is travelling along, a pre-intersection location such as a geophysical location of the probe apparatus 20 (e.g., determined by a location sensor 30), a pre-intersection travel speed of the probe apparatus 20 and/or the corresponding vehicle 5 along at least a portion of the pre-intersection road segment, and/or the like. In an example embodiment, the pre-intersection travel speed may be an instantaneous travel speed, an average travel speed over a short time interval (e.g., 10 seconds, 30 seconds, one minute, and/or the like), an average speed over a short distance interval (e.g., along the length of road segment, along a portion of the road segment, and/or the like). In an example embodiment, the pre-intersection travel speed may be determined by one or more sensors 30 (e.g., GPS, IMU, and/or the like), by the vehicle's 5 speedometer, and/or the like. In an example embodiment, the apparatus 10 may receive the instance of pre-intersection probe information/data provided (e.g., transmitted) by the probe apparatus 20 and store the instance of pre-intersection probe information/data in short and/or long term storage (e.g., memory 14). A plurality of instances of pre-intersection probe information/data may be received. In an example embodiment, the pre-intersection probe information/data may be analyzed in time bins. For example, the instances of pre-intersection probe information/data received during a one minute, five minute, ten minute, and/or the like period may be binned together and/or analyzed together.

Continuing with block 104 of FIG. 3, post-intersection probe information/data is received. For example, the apparatus 10 may receive post-intersection probe information/data. For example, the apparatus 10 may comprise means, such as processor 12, memory 14, and communication interface 16, and/or the like, for receiving post-intersection probe information/data. In an example embodiment, the apparatus 10 may receive a plurality of instances of post-intersection probe information/data from a plurality of probe apparatuses 20 traveling along a post-intersection road segment following the intersection. In an example embodiment, the probe apparatus 20 may provide post-intersection probe information/data corresponding to traveling along the post-intersection road segment 60A or 60B. In an example embodiment, the post-intersection road segment 60A, 60B immediately follows the intersection 70. For example, one end of the post-intersection road segment 60A, 60B may abut the intersection 70. In another example, the post-intersection road segment 60A, 60B may begin at the intersection 70. At least one of the probe apparatuses 20 that provided pre-intersection probe information/data also provides post-intersection probe information/data.

In an example embodiment, an instance of post-intersection probe information/data may comprise at least one of a probe identifier configured to identify the probe apparatus 20 capturing and/or providing the post-intersection probe information/data, a post-intersection link identifier configured to identify the digital map link representing the post-intersection road segment the probe apparatus 20 is travelling along, a post-intersection location such as a geophysical location of the probe apparatus 20 (e.g., determined by a location sensor 30), a post-intersection travel speed of the probe apparatus 20 and/or the corresponding vehicle 5 along at least a portion of the post-intersection road segment, and/or the like. In an example embodiment, the post-intersection travel speed may be an instantaneous travel speed, an average travel speed over a short time interval (e.g., 10 seconds, 30 seconds, one minute, and/or the like), an average speed over a short distance interval (e.g., along the length of road segment, along a portion of the road segment, and/or the like). In an example embodiment, the post-intersection travel speed may be determined by one or more sensors 30 (e.g., GPS, IMU, and/or the like), by the vehicle's 5 speedometer, and/or the like. In an example embodiment, the apparatus 10 may receive the instance of post-intersection probe information/data provided (e.g., transmitted) by the probe apparatus 20 and store the instance of post-intersection probe information/data in short and/or long term storage (e.g., memory 14). A plurality of instances of post-intersection probe information/data may be received. In an example embodiment, the post-intersection probe information/data may be analyzed in time bins. For example, the instances of post-intersection probe information/data received during a one minute, five minute, ten minute, and/or the like period may be binned together and/or analyzed together. In another example, the instances of post-intersection probe information/data that can be matched, based on the probe identifier, to pre-intersection probe information/data that was received during a one minute, five minute, ten minute, and/or the like period may be binned together and/or analyzed together.

At block 106, the pre-intersection probe information/data and the post-intersection probe information/data is clustered based on the corresponding post-intersection probe information/data. For example, an instance of pre-intersection probe information/data may be matched to an instance of post-intersection probe information/data based on the instance of pre-intersection probe information/data comprising the same probe identifier as the instance of post-intersection probe information/data. For example, a first instance of pre-intersection probe information/data may be matched to a first instance of post-intersection probe information/data based on the two instances of probe information/data comprising the same first probe identifier corresponding to a first probe apparatus 20. The first instance of the pre-intersection probe information/data and the first instance of post-intersection probe information/data may provide a sequence of road segments traveled by the first probe apparatus 20 and/or the corresponding vehicle 5. For example, the first instance of pre-intersection probe information/data may comprise information/data that may be used to identify the pre-intersection road segment 50 and the first instance of post-intersection probe information/data may comprise information/data that may be used to identify the post-intersection road segment 60A or 60B traveled by the first probe apparatus 20 and/or the vehicle 5. Thus, based on the matched pair of instances of pre-intersection probe information/data and post-intersection probe information/data, the direction that the probe apparatus 20 and/or vehicle 5 are traveling in may be determined. The first instance of pre-intersection probe information/data and the first instance of post-intersection probe information/data may then be classified based on the post-intersection road segment indicated by the first instance of post-intersection probe information/data. For example, if the first instance of post-information/data indicates that the first probe apparatus 20 and/or the vehicle 5A traveled a first post-intersection road segment 60A, the first instance of pre-intersection probe information/data and the first instance of the post-intersection probe information/data may be classified as corresponding to the first post-intersection road segment 60A. Similarly, if a second instance of post-information/data indicates that the second probe apparatus 20 and/or the vehicle 5B traveled a second post-intersection road segment 60B, the second instance of pre-intersection probe information/data and the second instance of the post-intersection probe information/data may be classified as corresponding to the second post-intersection road segment 60B.

Similarly, each, or at least some, of the plurality of instances of pre-intersection probe information/data may be matched to corresponding instances of post-intersection probe information/data and classified based on the post-intersection road segment indicated by the corresponding post-intersection probe information/data. The instances of pre-intersection probe information/data may then be clustered based on classification. For example, the instances of pre-intersection probe information/data corresponding to post-intersection probe information/data identifying a first post-intersection road segment 60A, may be clustered and/or organized into a first pre-intersection cluster. Similarly, the instances of pre-intersection probe information/data corresponding to post-intersection probe information/data identifying a second post-intersection road segment 60B, may be clustered and/or organized into a second pre-intersection cluster. Thus, in an example embodiment, the apparatus 10 may cluster the pre-intersection probe information/data based on the post-intersection probe information/data. For example, the apparatus 10 may comprise means, such as the processor 12 and/or the like, for clustering instances of pre-intersection probe information/data based on information/data provided by a corresponding instance of post-intersection probe information/data.

Additionally, the post-intersection probe information/data may be similarly clustered. For example, if a first instance of post-intersection probe information/data provides information/data identifying a first post-intersection road segment 60A, the first instance of post-intersection probe information/data may be clustered into a first post-intersection cluster with other instances of post-intersection probe information/data that also comprise information/data identifying the first post-intersection road segment 60A. In another example, if a second instance of post-intersection probe information/data provides information/data identifying a second post-intersection road segment 60B, the second instance of post-intersection probe information/data may be clustered into a second post-intersection cluster with other instances of post-intersection probe information/data that also comprise information/data identifying the second post-intersection road segment 60B. Thus, in an example embodiment, the apparatus 10 may cluster the post-intersection probe information/data based on the post-intersection probe information/data (e.g., based on a post-intersection road segment identified thereby). For example, the apparatus 10 may comprise means, such as the processor 12 and/or the like, for clustering instances of post-intersection probe information/data based on the instance of the post-intersection probe information/data.

In an example embodiment, there may be one or more instances of pre-intersection probe information/data for which a post-intersection road segment 60A, 60B cannot be determined. For example, the apparatus 10 may not receive post-intersection probe information/data from the probe apparatus 20 associated with the probe identifier corresponding to the instance pre-intersection probe information/data. In an example embodiment, an instance of pre-intersection probe information/data for which a post-intersection road segment 60A, 60B cannot be determined may not be clustered into a pre-intersection cluster. For example, that instance of pre-intersection probe information/data may not be considered in determining if the intersection is experiencing and/or causing a split lane traffic jam. In another example embodiment, an instance of pre-intersection probe information/data for which a post-intersection road segment 60A, 60B cannot be determined may be clustered by assigning the instance of pre-intersection probe information/data to the pre-intersection cluster having an average speed most similar to the travel speed of the instance of pre-intersection probe information/data. For example, the K-nearest neighbor approach may be used to assign the instance of pre-intersection probe information/data for which a post-intersection road segment 60A, 60B cannot be determined to a pre-intersection cluster based on the average speed of the pre-intersection cluster and the travel speed corresponding to the instance of pre-intersection probe information/data.

At block 108, a TLI is determined, computed, generated, and/or the like for each cluster. For example, for each pre-intersection and each post-intersection cluster, the apparatus 10 may determine, compute, and/or generate a TLI. For example, the apparatus 10 may comprise means, such as processor 12 and/or the like, for determining, computing, and/or generating a TLI for each cluster. In an example embodiment, each pre-intersection cluster and each post-intersection cluster may be independently analyzed to determine a TLI for the corresponding cluster. For example, a TLI may be determined, computed, generated and/or the like based on the probe information/data of the cluster. For example, a first pre-intersection cluster may comprise a plurality of instances of pre-intersection probe information/data corresponding to probe apparatuses 20 and/or vehicles 5 who traveled through the intersection 70 such that the probe apparatuses 20 and/or vehicles 5 provided post-intersection probe information/data identifying a first post-intersection road segment 60A. The plurality of instances of pre-intersection probe information/data of the first pre-intersection cluster each comprise a travel speed corresponding to the speed at which at least a portion of the pre-intersection road segment 50 was traveled by the corresponding probe apparatus 20 and/or vehicle 5. The travel speed of the instances of pre-intersection probe information/data in the first pre-intersection cluster may be analyzed to determine a first pre-intersection TLI. In an example embodiment, the average travel speed (e.g., mean, mode, or median), range of travel speeds, distribution of travel speeds, and/or the like for the first pre-intersection cluster may be determined, computed, and/or the like. A first pre-intersection TLI may then be determined, computed, generated, and/or the like based on the analysis of the travel speed for the first pre-intersection cluster. In various embodiments, various other types of probe information/data of the first pre-intersection cluster may be analyzed and/or considered when determining, computing, generating, and/or the like the first pre-intersection TLI. Similarly, probe information/data (e.g., travel speed) corresponding to the second pre-intersection cluster may be analyzed to determine, compute, generate, and/or the like the second pre-intersection TLI. As should be understood, based on the above, the number of pre-intersection clusters are intersection dependent. In an example embodiment, the number of pre-intersection clusters is the same as the number of post-intersection clusters for a particular intersection 70. A TLI is determined for each pre-intersection cluster.

A TLI is also determined for each post-intersection cluster. For example, a first post-intersection cluster may comprise a plurality of instances of post-intersection probe information/data corresponding to probe apparatuses 20 and/or vehicles 5 who traveled through the intersection 70 such that the probe apparatuses 20 and/or vehicles 5 provided post-intersection probe information/data identifying a first post-intersection road segment 60A. The plurality of instances of post-intersection probe information/data of the first post-intersection cluster each comprise a travel speed corresponding to the speed at which at least a portion of the post-intersection road segment 60A was traveled by the corresponding probe apparatus 20 and/or vehicle 5A. The travel speed of the instances of post-intersection probe information/data in the first post-intersection cluster may be analyzed to determine a first post-intersection TLI. In an example embodiment, the average travel speed (e.g., mean, mode, or median), range of travel speeds, distribution of travel speeds, and/or the like for the first post-intersection cluster may be determined, computed, and/or the like. A first post-intersection TLI may then be determined, computed, generated, and/or the like based on the analysis of the travel speed for the first post-intersection cluster. In various embodiments, various other types of probe information/data of the first post-intersection cluster may be analyzed and/or considered when determining, computing, generating, and/or the like the first post-intersection TLI. Similarly, probe information/data (e.g., travel speed) corresponding to the second post-intersection cluster may be analyzed to determine, compute, generate, and/or the like the second post-intersection TLI. As should be understood, based on the above, the number of post-intersection clusters are intersection dependent. A TLI is determined for each post-intersection cluster.

In an example embodiment, determining, computing, generating, and/or the like a TLI for a road segment comprises determining, computing, generating, and/or the like a ratio of a travel speed along a road segment to the free flow speed for the road segment. For example, the TLI may be a ratio of the average travel speed for the cluster to a free flow speed for the road segment corresponding to the travel speed (e.g., the road segment the probe apparatus 20 and/or vehicle 5 was traveling along when the travel speed of the probe information/data was determined). For example, if a particular road segment has a speed limit, the free flow speed may be the speed limit. In another example, the free flow speed may be an expected speed along the road segment (e.g., which may be based on certain conditions such as the type of road, time of day, day of the week, weather conditions, and/or the like). For example, the free flow speed for a segment of a particular road under certain conditions may be 30 mph even through the speed limit for the road segment is 45 mph. In another example, the free flow speed for a segment of a particular road under certain conditions may be 70 mph even through the speed limit of the road segment is 60 mph. Thus, for example, in an example embodiment, a first pre-intersection TLI may be the ratio of the average travel speed of the instances of pre-intersection probe information/data comprising the first pre-intersection cluster to the free flow speed for the pre-intersection road segment 50. In various embodiments, the free flow speed for the pre-intersection road segment 50 may be determined, generated, computed, identified, and/or the like based on at least one of the particular road segment 50, the classification of the road segment 50 (e.g., highway, interstate, arterial road, surface street, road class, and/or the like), current conditions (time of day, day of the week, weather conditions, and/or the like), and/or the like. The free flow speed for a post-intersection road segment 60A, 60B may be similarly determined, generated, computed, identified, and/or the like based on at least one of the particular road segment 60A, 60B, the classification of the road segment 60A, 60B (e.g., highway, interstate, arterial road, surface street, road class, and/or the like), current conditions (time of day, day of the week, weather conditions, and/or the like), and/or the like. Thus, in an example embodiment, the first pre-intersection TLI may be or may be based on the ratio of the average travel speed of the first pre-intersection cluster in instances of pre-intersection probe information/data and the free flow speed for the pre-intersection road segment 50. It should be understood that a second, third, etc. pre-intersection and/or first, second, etc. post-intersection TLI may be similarly determined, in an example embodiment.

In an example embodiment, determining, computing, generating, and/or the like a TLI for a road segment comprises determining, computing, generating, and/or the like a normalized ratio of average travel speed along a road segment to the free flow speed for the road segment. For example, the TLI may be a normalized ratio of the average travel speed for the cluster to a free flow speed for road segment corresponding to the travel speed (e.g., the road segment the probe apparatus 20 and/or vehicle 5 was traveling along when the travel speed of the probe information/data was determined). For example, the ratio of travel speed to free flow speed may be normalized such that the ratio for different types or classes of roads may be compared. For example, if the travel speed along a road segment is 75% of the free flow speed, drivers may experience the flow of traffic differently if the road segment is a highway road segment versus a surface street road segment. Thus, in an example embodiment, the ratio of travel speed to free flow speed may be normalized such that ratios relating to different types of road segments may be compared. For example, the normalization factor used to normalize the ratio of travel speed to free flow speed for a road segment may be based on the type of road segment. For example, highways may be assigned a highway normalization factor, arterial roads may be assigned an arterial normalization factor, city streets may be assigned a city street normalization factor, rural surface streets may be assigned a rural normalization factor, and/or the like. Therefore, in an example embodiment, the first pre-intersection TLI is the ratio of the average travel speed of the instances of pre-intersection probe information/data comprising the first pre-intersection cluster to the free flow speed for the pre-intersection road segment 50 normalized by a normalization factor corresponding to the road segment type corresponding to the pre-intersection road segment 50. It should be understood that a second, third, etc. pre-intersection and/or first, second, etc. post-intersection TLI may be similarly determined, in an example embodiment.

In an example embodiment, a TLI for a road segment and/or a corresponding cluster (e.g., a first pre-intersection TLI corresponding to a pre-intersection road segment and/or a first pre-intersection cluster, a second post-intersection TLI corresponding to a second post-intersection road segment and/or a second post-intersection cluster, and/or the like) may comprise determining a road segment type for the road segment. For example, a digital map may comprise a link that represents the road segment in the digital map. A link record corresponding to the link may comprise a road segment type corresponding to the link. Thus, the apparatus 10 may determine a road segment type for the road segment. A road segment type normalization factor for the road segment type may be identified. For example, a normalization factor that corresponds to the road segment type may be identified. For example, a reference table of normalization factors and the corresponding road segment types may be used to identify a road segment type normalization factor for the road segment type. Thus, the apparatus 10 may determine a road segment type normalization factor for the road segment type. Based on the probe information/data, an average travel speed for the road segment may be determined and a ratio of the average travel speed to a free flow speed for the road segment may be determined. For example, the apparatus 10 may determine an average travel speed for the road segment based on instances of probe information/data of the corresponding cluster, determine a free flow speed for the road segment, and determine a ratio of the average travel speed to the free flow speed. The road segment type normalization factor may then be applied to, multiplied by, and/or the like the ratio of the average travel speed to the free flow speed. For example, the apparatus 10 may apply or multiply the road segment type normalization factor to the ratio of the average travel speed to the free flow speed to determine the TLI for the road segment and/or the corresponding cluster.

Continuing with FIG. 3, at block 110, the difference between the pre-intersection TLIs and the corresponding post-intersection TLIs may be determined. For example, a first TLI difference may be determined by determining the difference between the first pre-intersection TLI and the first post-intersection TLI. Similarly, a second TLI difference may be determined by determining the difference between the second pre-intersection TLI and the second post-intersection TLI. For example, the apparatus 10 may determine the TLI differences. For example, the apparatus 10 may comprise means, such as the processor 12 and/or the like, for determining at least the first TLI difference and the second TLI difference. At block 112, each TLI difference may be compared to a threshold TLI difference to determine if the TLI difference satisfies a threshold requirement. In an example embodiment, the TLI is a normalized ratio and the threshold TLI difference is 2. In an example embodiment, the threshold requirement is that the TLI difference is greater than the threshold TLI difference. As should be understood the threshold TLI difference applied will vary based on the TLI used to represent the traffic levels of the pre-intersection road segment 50 and the post-intersection road segments 60A, 60B.

At block 112, it is determined if any of the TLI differences are greater than the threshold TLI difference. For example, it may be determined if either or both of the first and second TLI differences are greater than the threshold TLI difference. For example, the apparatus 10 may determine if any of the TLI differences are greater than the threshold TLI difference. For example, the apparatus 10 may comprise means, such as the processor 12 and/or the like, for determining if any of the TLI differences are greater than the threshold TLI difference.

At block 118, if it is determined that none of the TLI differences is greater than the threshold TLI difference, then it is determined that the intersection is not experiencing and/or causing a split lane traffic jam. For example, determining that none of the TLI differences is greater than the threshold TLI difference may trigger the apparatus 10 to determine that the intersection is not experiencing and/or causing a split lane traffic jam. For example, the apparatus 10 may comprise means, such as processor 12 and/or the like, for, responsive to determining that none of the TLI differences is greater than the threshold TLI difference, determining that the intersection is not experiencing and/or causing a split lane traffic jam. In an example embodiment, the process is then ended. In an example embodiment, the process may then receive and/or analyze another time bin of probe information/data.

FIG. 5A illustrates the TLIs for the first and second pre-intersection clusters and the first and second post-intersection clusters corresponding to the intersection 70 shown in FIG. 4A. FIG. 5B illustrates the TLIs for the first and second pre-intersection clusters and the first and second post-intersection clusters corresponding to the intersection 70 shown in FIG. 4B. Looking at FIGS. 4A and 5A, it can seen that vehicles 5A that will travel the first post-intersection road segment 60A are experiencing slower driving conditions along both the pre-intersection road segment 50 and the first post-intersection road segment 60A. However, the vehicles 5B that will travel the second post-intersection road segment 60B are experiencing nearly free flow driving conditions along both the pre-intersection road segment 50 and the second post intersection road segment 60B. Thus, in the situation illustrated by FIGS. 4A and 5A, the intersection 70 is not experiencing a split lane traffic jam. FIG. 5A indicates that, in an example embodiment wherein each TLI is a normalized ratio of travel speed to free flow speed, the first pre-intersection TLI is 6 and the first post-intersection TLI is 6. Thus, the first TLI difference is equal to zero. If the threshold TLI difference is 2, then the first TLI difference is not greater than the threshold TLI difference. FIG. 5A further indicates that the second pre-intersection TLI is 2 and the second post-intersection TLI is 1. Thus, the second TLI difference is equal to 1 and the second TLI difference is not greater than the threshold difference. Thus, based on the analysis of the probe information/data corresponding to the intersection 70, the intersection 70 shown in FIG. 4A is determined to not be experiencing and/or causing a split lane traffic jam.

Returning to FIG. 3, at block 114, if it is determined that at least one of the TLI differences is greater than the threshold TLI difference, then it is determined that the intersection is experiencing and/or causing a split lane traffic jam. For example, determining that at least one of the TLI differences is greater than the threshold TLI difference may trigger the apparatus 10 to determine that the intersection is experiencing and/or causing a split lane traffic jam. For example, the apparatus 10 may comprise means, such as processor 12 and/or the like, for, responsive to determining that at least one of the TLI differences is greater than the threshold TLI difference, determining that the that the intersection is experiencing and/or causing a split lane traffic jam. Thus, if one of the pre-intersection TLIs is significantly larger than the corresponding post-intersection TLI, it is determined that the intersection is experiencing and/or causing a split lane traffic jam.

For example, looking at FIGS. 4B and 5B, it can be seen that vehicles 5A that will travel the first post-intersection road segment 60A are experiencing slower driving conditions along both the pre-intersection road segment 50 and the first post-intersection road segment 60A; and the vehicles 5B that will travel the second post-intersection road segment 60B are experiencing slower driving conditions along the pre-intersection road segment 50 and experiencing free flow driving conditions along the second post intersection road segment 60B. Thus, in the situation illustrated in FIGS. 4B and 5B, the intersection 70 is experiencing and/or causing a split lane traffic jam. FIG. 5B indicates that, in an example embodiment wherein each TLI is a normalized ratio of travel speed to free flow speed, the first pre-intersection TLI is 6 and the first post-intersection TLI is 6. Thus, the first TLI difference is equal to zero. If the threshold TLI difference is 2, than the first TLI difference is not greater than the threshold TLI difference. FIG. 5B further indicates that the second pre-intersection TLI is 5 and the second post-intersection TLI is 1. Thus, the second TLI difference is equal to 4 and the second TLI difference is greater than the threshold difference. Thus, based on the analysis of the probe information/data corresponding to the intersection 70, the intersection 70 shown in FIG. 4B is determined to be experiencing and/or causing a split lane traffic jam.

Thus, the apparatus 10 may analyze probe information/data to identify one or more intersections that are experiencing and/or causing split lane traffic jams. In an example embodiment, an intersection for which corresponding probe information/data is analyzed is a split lane intersection. In an example embodiment, the analysis of the probe information/data may allow for one or more intersections that are experiencing and/or causing split lane traffic jams to be identified in real time or near real time.

Returning to FIG. 3, at block 116, one or more traffic jam notifications may be provided (e.g., transmitted) to one or more computing entities 35. For example, the apparatus 10 may provide one or more traffic jam notifications to one or more computing entities 35. For example, the apparatus 10 may comprise means, such as processor 12, communications interface 16, and/or the like, for providing one or more traffic jam notifications to one or more computing entities 35. In an example embodiment, the one or more traffic jam notifications may be triggered in response to determining that an intersection is experiencing and/or causing a split lane traffic jam.

For example, a computing entity 35 may be a probe apparatus 20 (e.g., corresponding to a vehicle 5 that is approaching the intersection and/or expected to travel through the intersection on a current trip or an expected trip)

or a traffic management apparatus. For example, the computing entity 35 may be a computing entity that is operated by and/or on behalf of a traffic management agency (e.g., a local department of transportation, city traffic management office, and/or the like). In an example embodiment, the traffic jam notification may comprise computer-executable code and/or reference computer-executable code that, when executed by the computing entity 35 may cause the computing entity 35 to provide a traffic jam alert through a user interface thereof (e.g., a display, audible alert, and/or the like). In an example embodiment, the traffic jam alert may instruct a driver to get into an exit lane or the like earlier than planned and/or expected. Thus, the traffic jam alert may attempt to prevent drivers from exacerbating the split lane traffic jam. In an example embodiment, the computing entity 35 may, responsive to receiving the traffic jam notification and/or responsive to executing the computer-executable code therein and/or referenced thereby, perform one or more route planning computations, determinations, and/or the like. For example, a route planning computation, determination, and/or the like may comprise re-calculating a route (e.g., a route from a start location and/or the current location to a destination location), determining an updated arrival or travel time, and/or the like. For example, in an example embodiment, an application may be operating on the computing entity 35 that has access to a library of computer-executable code. The traffic jam notification may reference computer-executable code accessible through the library that the application may then access and execute to cause the computing entity 35 to provide a traffic jam alert through a user interface thereof and/or to perform one or more route calculations. After providing the one or more traffic jam notifications, the process may end, in an example embodiment. In another example embodiment, after providing the one or more traffic jam notifications, the apparatus 10 may receive and/or analyze another time bin of probe information/data.

In some embodiments, the apparatus 10 may track intersections identified as experiencing and/or causing split lane traffic jams. For example, the apparatus 10 may store an intersection database (or other data structure) that may be updated to include an indication of each time an intersection is identified as experiencing and/or causing a split lane traffic jam. For example, if a particular intersection tends to be experiencing and/or split lane causing a traffic jam, the apparatus 10 may provide a traffic jam notification to a computing entity 35 corresponding to a traffic management agency that identifies the particular intersection as a problem intersection. The identification of a particular intersection as a problem intersection may trigger the apparatus 10 to provide one or more problem intersection traffic jam notifications. The problem intersection traffic jam notification may trigger action on the part of the traffic management agency to modify the intersection (or a nearby intersection such as an intersection at the end of an exit ramp) to remedy the split lane traffic jams. For example, an intersection may be modified by adjusting the timing of a traffic light corresponding to the intersection or at the end of an exit ramp corresponding to the intersection, changing the signage (e.g., a stop sign to a yield sign and or the like), installing a traffic light, updating a traffic light (e.g., to include a turn light and/or the like), changing the topology and/or traffic flow through the intersection (e.g., adding an exit lane and/or the like), and/or the like. In an example embodiment, it may be determined that an intersection tends to be experiencing and/or causing a split lane traffic jam if the intersection is identified as experiencing or causing a split lane traffic jam repeatedly, such as by experiencing or causing a split lane traffic jam at at least a predetermined frequency, or continuously for a predefined length of time, such as fifteen minutes, thirty minutes, an hour, two hours, and/or the like. In an example embodiment, it may be determined that an intersection tends to be experiencing and/or causing a split lane traffic jam if the intersection is identified as experiencing or causing a split lane traffic jam two, three, four days, and/or the like in a row; two, three, four days, and/or the like in a week; two, three, four days, and/or the like in a month; and/or the like. Thus, certain example embodiments are configured to remedy split lane traffic jams being experienced by and/or caused by an intersection.

III. Example Apparatus

The probe apparatus 20, computing entity 35, and/or apparatus 10 of an example embodiment may be embodied by or associated with a variety of computing devices including, for example, a navigation system including an in-vehicle navigation system, a vehicle control system, a personal navigation device (PND) or a portable navigation device, an advanced driver assistance system (ADAS), a global positioning system (GPS), a cellular telephone, a mobile phone, a personal digital assistant (PDA), a watch, a camera, a computer, and/or other device that can perform navigation-related functions, such as digital routing and map display. Additionally or alternatively, the probe apparatus 20, computing entity 35, and/or apparatus 10 may be embodied in other types of computing devices, such as a server, a personal computer, a computer workstation, a laptop computer, a plurality of networked computing devices or the like, that are configured to update one or more map tiles, analyze probe points for route planning or other purposes. In an example embodiment, a probe apparatus 20 may be in-vehicle navigation device, the apparatus 10 may be a server, a computing entity 35 may be an in-navigation device and another computing entity 35 may be a computer workstation or server at a traffic management agency. In this regard, FIG. 2A depicts an apparatus 10 and FIG. 2B depicts a probe apparatus 20 of an example embodiment that may be embodied by various computing devices including those identified above. As shown, the apparatus 10 of an example embodiment may include, may be associated with or may otherwise be in communication with a processor 12 and a memory device 14 and optionally a communication interface 16 and/or a user interface 18. Similarly, a probe apparatus 20 of an example embodiment may include, may be associated with, or may otherwise be in communication with a processor 22, and a memory device 24, and optionally a communication interface 26, a user interface 28, one or more sensors 30 (e.g., a location sensor such as a GPS sensor, IMU sensors, and/or the like; camera(s); 2D and/or 3D LiDAR(s); long, medium, and/or short range RADAR; ultrasonic sensors; electromagnetic sensors; (near-)IR cameras, 3D cameras, 360° cameras; and/or other sensors that enable the probe apparatus to determine one or more features of the corresponding vehicle's 5 surroundings), and/or other components configured to perform various operations, procedures, functions, or the like described herein. In an example embodiment, a computing entity 35 may, similar to the apparatus 10 and/or probe apparatus 20, comprise a processor, memory device, communication interface, user interface, and/or one or more additional components configured to perform various operations, procedures, functions, or the like described herein. In an example embodiment, a computing entity may comprise one or more sensors similar to the one or more sensors 30.

In some embodiments, the processor 12, 22 (and/or co-processors or any other processing circuitry assisting or otherwise associated with the processor) may be in communication with the memory device 14, 24 via a bus for passing information among components of the apparatus. The memory device may be non-transitory and may include, for example, one or more volatile and/or non-volatile memories. In other words, for example, the memory device may be an electronic storage device (e.g., a computer readable storage medium) comprising gates configured to store data (e.g., bits) that may be retrievable by a machine (e.g., a computing device like the processor). The memory device may be configured to store information, data, content, applications, instructions, or the like for enabling the apparatus to carry out various functions in accordance with an example embodiment of the present invention. For example, the memory device could be configured to buffer input data for processing by the processor. Additionally or alternatively, the memory device could be configured to store instructions for execution by the processor.

As described above, the apparatus 10, computing entity 35, and/or probe apparatus 20 may be embodied by a computing device. However, in some embodiments, the apparatus may be embodied as a chip or chip set. In other words, the apparatus may comprise one or more physical packages (e.g., chips) including materials, components and/or wires on a structural assembly (e.g., a baseboard). The structural assembly may provide physical strength, conservation of size, and/or limitation of electrical interaction for component circuitry included thereon. The apparatus may therefore, in some cases, be configured to implement an embodiment of the present invention on a single chip or as a single "system on a chip." As such, in some cases, a chip or chipset may constitute means for performing one or more operations for providing the functionalities described herein.

The processor 12, 22 may be embodied in a number of different ways. For example, the processor may be embodied as one or more of various hardware processing means such as a coprocessor, a microprocessor, a controller, a digital signal processor (DSP), a processing element with or without an accompanying DSP, or various other processing circuitry including integrated circuits such as, for example, an ASIC (application specific integrated circuit), an FPGA (field programmable gate array), a microcontroller unit (MCU), a hardware accelerator, a special-purpose computer chip, or the like. As such, in some embodiments, the processor may include one or more processing cores configured to perform independently. A multi-core processor may enable multiprocessing within a single physical package. Additionally or alternatively, the processor may include one or more processors configured in tandem via the bus to enable independent execution of instructions, pipelining and/or multithreading.

In an example embodiment, the processor 12, 22 may be configured to execute instructions stored in the memory device 14, 24 or otherwise accessible to the processor. For example, the processor 22 may be configured to execute computer-executed instructions embedded within a link record of a map tile. Alternatively or additionally, the processor may be configured to execute hard coded functionality. As such, whether configured by hardware or software methods, or by a combination thereof, the processor may represent an entity (e.g., physically embodied in circuitry) capable of performing operations according to an embodiment of the present invention while configured accordingly. Thus, for example, when the processor is embodied as an ASIC, FPGA or the like, the processor may be specifically configured hardware for conducting the operations described herein. Alternatively, as another example, when the processor is embodied as an executor of software instructions, the instructions may specifically configure the processor to perform the algorithms and/or operations described herein when the instructions are executed. However, in some cases, the processor may be a processor of a specific device (e.g., a pass-through display or a mobile terminal) configured to employ an embodiment of the present invention by further configuration of the processor by instructions for performing the algorithms and/or operations described herein. The processor may include, among other things, a clock, an arithmetic logic unit (ALU) and logic gates configured to support operation of the processor.

In some embodiments, the apparatus 10, computing entity 35, and/or probe apparatus 20 may include a user interface 18, 28 that may, in turn, be in communication with the processor 12, 22 to provide output to the user, such as a proposed route, and, in some embodiments, to receive an indication of a user input. As such, the user interface may include a display and, in some embodiments, may also include a keyboard, a mouse, a joystick, a touch screen, touch areas, soft keys, a microphone, a speaker, or other input/output mechanisms. Alternatively or additionally, the processor may comprise user interface circuitry configured to control at least some functions of one or more user interface elements such as a display and, in some embodiments, a speaker, ringer, microphone and/or the like. The processor and/or user interface circuitry comprising the processor may be configured to control one or more functions of one or more user interface elements through computer program instructions (e.g., software and/or firmware) stored on a memory accessible to the processor (e.g., memory device 14, 24, and/or the like).

The apparatus 10, computing entity 35, and/or the probe apparatus 20 may optionally include a communication interface 16, 26. The communication interface may be any means such as a device or circuitry embodied in either hardware or a combination of hardware and software that is configured to receive and/or transmit data from/to a network and/or any other device or module in communication with the apparatus. In this regard, the communication interface may include, for example, an antenna (or multiple antennas) and supporting hardware and/or software for enabling communications with a wireless communication network. Additionally or alternatively, the communication interface may include the circuitry for interacting with the antenna(s) to cause transmission of signals via the antenna(s) or to handle receipt of signals received via the antenna(s). In some environments, the communication interface may alternatively or also support wired communication. As such, for example, the communication interface may include a communication modem and/or other hardware/software for supporting communication via cable, digital subscriber line (DSL), universal serial bus (USB) or other mechanisms.

In addition to embodying the apparatus 10, computing entity 35, and/or probe apparatus 20 of an example embodiment, a navigation system may also include or have access to a geographic database that includes a variety of data (e.g., map information/data) utilized in constructing a route or navigation path and determining the time to traverse the route or navigation path. For example, a geographic database may include node data records (e.g., including anchor node data records comprising junction identifiers), road segment or link data records, point of interest (POI) data records and other data records. More, fewer or different data records can be provided. In one embodiment, the other data records include cartographic ("cartel") data records, routing data, and maneuver data. One or more portions, components, areas, layers, features, text, and/or symbols of the POI or event data can be stored in, linked to, and/or associated with one or more of these data records. For example, one or more portions of the POI, event data, or recorded route information can be matched with respective map or geographic records via position or GPS data associations (such as using known or future map matching or geo-coding techniques), for example. In an example embodiment, the data records (e.g., node data records, link data records, POI data records, and/or other data records) may comprise computer-executable instructions, a reference to a function repository that comprises computer-executable instructions, one or more coefficients and/or parameters to be used in accordance with an algorithm for performing the analysis, one or more response criteria for providing a response indicating a result of the analysis, and/or the like. In at least some example embodiments, the probe apparatus 20 and/or computing entity 35 may be configured to execute computer-executable instructions provided by and/or referred to by a data record. In an example embodiment, the apparatus 10 may be configured to modify, update, and/or the like one or more data records of the geographic database.

In an example embodiment, the road segment data records are links or segments, e.g., maneuvers of a maneuver graph, representing roads, streets, or paths, as can be used in the calculated route or recorded route information for determination of one or more personalized routes. The node data records are end points corresponding to the respective links or segments of the road segment data records. The road link data records and the node data records represent a road network, such as used by vehicles, cars, and/or other entities. Alternatively, the geographic database can contain path segment and node data records or other data that represent pedestrian paths or areas in addition to or instead of the vehicle road record data, for example.

The road/link segments and nodes can be associated with attributes, such as geographic coordinates, street names, address ranges, speed limits, turn restrictions at intersections, and other navigation related attributes, as well as POIs, such as gasoline stations, hotels, restaurants, museums, stadiums, offices, automobile dealerships, auto repair shops, buildings, stores, parks, etc. The geographic database can include data about the POIs and their respective locations in the POI data records. The geographic database can also include data about places, such as cities, towns, or other communities, and other geographic features, such as bodies of water, mountain ranges, etc. Such place or feature data can be part of the POI data or can be associated with POIs or POI data records (such as a data point used for displaying or representing a position of a city). In addition, the geographic database can include and/or be associated with event data (e.g., traffic incidents, constructions, scheduled events, unscheduled events, etc.) associated with the POI data records or other records of the geographic database.

The geographic database can be maintained by the content provider (e.g., a map developer) in association with the services platform. By way of example, the map developer can collect geographic data to generate and enhance the geographic database. There can be different ways used by the map developer to collect data. These ways can include obtaining data from other sources, such as municipalities or respective geographic authorities. In addition, the map developer can employ field personnel to travel by vehicle along roads throughout the geographic region to observe features and/or record information about them, for example. Also, remote sensing, such as aerial or satellite photography, can be used. In an example embodiment, the geographic database may be updated based on information/data provided by one or more probe apparatuses.

The geographic database can be a master geographic database stored in a format that facilitates updating, maintenance, and development. For example, the master geographic database or data in the master geographic database can be in an Oracle spatial format or other spatial format, such as for development or production purposes. The Oracle spatial format or development/production database can be compiled into a delivery format, such as a geographic data files (GDF) format. The data in the production and/or delivery formats can be compiled or further compiled to form geographic database products or databases, which can be used in end user navigation devices or systems.

For example, geographic data is compiled (such as into a platform specification format (PSF)) to organize and/or configure the data for performing navigation-related functions and/or services, such as route calculation, route guidance, map display, speed calculation, distance and travel time functions, and other functions. The navigation-related functions can correspond to vehicle navigation or other types of navigation. The compilation to produce the end user databases can be performed by a party or entity separate from the map developer. For example, a customer of the map developer, such as a navigation device developer or other end user device developer, can perform compilation on a received geographic database in a delivery format to produce one or more compiled navigation databases. Regardless of the manner in which the databases are compiled and maintained, a navigation system that embodies an apparatus 10, computing entity 35, and/or probe apparatus 20 in accordance with an example embodiment may determine the time to traverse a route that includes one or more turns at respective intersections more accurately.

IV. Apparatus, Methods, and Computer Program Products

As described above, FIG. 3 illustrates a flowchart of apparatuses 10, method, and computer program product according to an example embodiment of the invention. It will be understood that each block of the flowcharts, and combinations of blocks in the flowcharts, may be implemented by various means, such as hardware, firmware, processor, circuitry, and/or other devices associated with execution of software including one or more computer program instructions. For example, one or more of the procedures described above may be embodied by computer program instructions. In this regard, the computer program instructions which embody the procedures described above may be stored by the memory device 14, 24 of an apparatus employing an embodiment of the present invention and executed by the processor 12, 22 of the apparatus. As will be appreciated, any such computer program instructions may be loaded onto a computer or other programmable apparatus (e.g., hardware) to produce a machine, such that the resulting computer or other programmable apparatus implements the functions specified in the flowchart blocks. These computer program instructions may also be stored in a computer-readable memory that may direct a computer or other programmable apparatus to function in a particular manner, such that the instructions stored in the computer-readable memory produce an article of manufacture the execution of which implements the function specified in the flowchart blocks. The computer program instructions may also be loaded onto a computer or other programmable apparatus to cause a series of operations to be performed on the computer or other programmable apparatus to produce a computer-implemented process such that the instructions which execute on the computer or other programmable apparatus provide operations for implementing the functions specified in the flowchart blocks.

Accordingly, blocks of the flowcharts support combinations of means for performing the specified functions and combinations of operations for performing the specified functions for performing the specified functions. It will also be understood that one or more blocks of the flowcharts, and combinations of blocks in the flowcharts, can be implemented by special purpose hardware-based computer systems which perform the specified functions, or combinations of special purpose hardware and computer instructions.

In some embodiments, certain ones of the operations above may be modified or further amplified. Furthermore, in some embodiments, additional optional operations may be included. Modifications, additions, or amplifications to the operations above may be performed in any order and in any combination.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed:

1. A method comprising:

receiving, by an apparatus, a plurality of instances of pre-intersection probe data, each instance being from a probe apparatus of a plurality of probe apparatuses, the probe apparatus comprising a plurality of sensors and on board a vehicle, wherein an instance of the plurality of instances of pre-intersection probe data comprises (a) a probe identifier configured to identify the corresponding probe apparatus and (b) a pre-intersection travel speed at which the corresponding vehicle traveled at least a portion of a pre-intersection road segment, wherein the vehicle traveled the pre-intersection road segment before traveling through an intersection, wherein the apparatus comprises a processor, a memory device, and a communication interface;

receiving, by the apparatus, a plurality of instances of post-intersection probe data, each instance being from a probe apparatus of the plurality of probe apparatuses, wherein an instance of the plurality of instances of post-intersection probe data comprises (a) the probe identifier corresponding to the probe apparatus, (b) a post-intersection travel speed at which the corresponding vehicle traveled at least a portion of a post-intersection road segment, and (c) information identifying the post-intersection road segment, wherein the vehicle traveled the post-intersection road segment after traveling through the intersection;

clustering, by the apparatus, instances of the plurality of instances of pre-intersection probe data based on the post-intersection road segment corresponding to each instance to generate two or more pre-intersection clusters;

clustering, by the apparatus, instances of the plurality of instances of post-intersection probe data based on the post-intersection road segment corresponding to each instance to generate two or more post-intersection clusters;

determining, by the apparatus, a pre-intersection traffic level indicator for each pre-intersection cluster probe data based on a pre-intersection travel speed for the corresponding pre-intersection cluster;

determining, by the apparatus, a post-intersection traffic level indicator for each cluster of post-intersection probe data based on a post-intersection speed for the corresponding post-intersection cluster; and responsive to determining that at least one traffic level indicator difference satisfies a threshold requirement, identifying, by the apparatus, the intersection as experiencing a traffic jam.

2. A method according to claim 1, wherein the pre-intersection road segment is immediately before the intersection.

3. A method according to claim 1, wherein the post-intersection road segment is immediately following the intersection.

4. A method according to claim 1, wherein a traffic level indicator for a road segment is determined by:

determining a road segment type for the road segment;

identifying a road segment type normalization factor for the road segment type;

based on the probe data, determining a ratio of average travel speed for the road segment to a free flow speed for the road segment; and applying the road segment type normalization factor to the ratio.

5. A method according to claim 1, wherein the traffic jam is a split lane traffic jam.

6. A method according to claim 1, wherein:

a first instance of the plurality of instances of post-intersection probe data comprises a first probe identifier and information identifying a first post-intersection road segment, and based on a first instance of the plurality of instances of pre-intersection probe data comprising the first probe identifier, the first instance of the plurality of instances of pre-intersection probe data is clustered into a first pre-intersection cluster, a second instance of the plurality of instances of post-intersection probe data comprises a second probe identifier and information identifying a second post-intersection road segment, and based on a second instance of the plurality of instances of pre-intersection probe data comprising the second probe identifier, the second instance of the plurality of instances of pre-intersection probe data is clustered into a second pre-intersection cluster, the first post-intersection road segment is different from the second post-intersection road segment and the first pre-intersection cluster is different from the second pre-intersection cluster.

7. A method according to claim 6, wherein:

a first pre-intersection traffic level indicator is determined based on an average first pre-intersection travel speed determined corresponding to the first pre-intersection cluster, and a second pre-intersection traffic level indicator is determined based on an average second pre-intersection travel speed determined corresponding to the second pre-intersection cluster.

8. A method according to claim 7, wherein:

the first instance of the plurality of instances of post-intersection probe data is clustered into a first post-intersection cluster, the second instance of the plurality of instances of post-intersection probe data is clustered into a second post-intersection cluster, a first post-intersection traffic level indicator is determined based on an average first post-intersection travel speed determined corresponding to the first post-intersection cluster, a second post-intersection traffic level indicator is determined based on an average second post-intersection travel speed determined corresponding to the second post-intersection cluster, the method further comprising:

determining a first travel level indicator difference by determining a difference between the first pre-intersection traffic level indicator and the first post-intersection traffic level indicator; and determining a second travel level indicator difference by determining the difference between the second pre-intersection traffic level indicator and the second post-intersection traffic level indicator.

9. A method according to claim 1, wherein in response to receiving an instance of the plurality of instances of post-intersection probe data corresponding to a particular probe apparatus, determining a direction of travel based on an instance of pre-intersection probe data comprising a probe identifier identifying the particular probe apparatus and the instance of the plurality of instances of post-intersection probe data, wherein the clustering of the instance of pre-intersection probe data corresponding to the particular probe apparatus is based at least in part on the direction of travel determined for the particular probe apparatus.

10. A method according to claim 1, further comprising, in response to identifying that the intersection is experiencing a traffic jam, providing a traffic jam notification to a computing entity, wherein responsive to receiving the traffic jam notification, the computing entity processes the traffic jam notification and, responsive to the processing, provides a traffic jam alert through a user interface of the computing entity, wherein the computing entity comprises at least one of a probe device or a traffic management apparatus.

11. A method according to claim 10, wherein in response to receiving the traffic jam notification, the computing entity (a) recalculates a route for traveling from a start location to a destination location or (b) determines an updated arrival or travel time.

12. A method according to claim 1, further comprising:

tracking the identifying of the intersection as experiencing a traffic jam;

determining, based on the tracking, that the intersection is a problem intersection; and providing a problem intersection traffic jam notification, wherein a computing entity receives the problem intersection traffic jam notification, and, responsive thereto, triggers a modification of the intersection or a nearby intersection.

13. An apparatus comprising at least one processor and at least one memory storing computer program code, the at least one memory and the computer program code configured to, with the processor, cause the apparatus to at least:

receive a plurality of instances of pre-intersection probe data, each instance being from a probe apparatus of a plurality of probe apparatuses, the probe apparatus comprising a plurality of sensors and on board a vehicle, wherein an instance of the plurality of instances of pre-intersection probe data comprises (a) a probe identifier configured to identify the corresponding probe apparatus and (b) a pre-intersection travel speed at which the corresponding vehicle traveled at least a portion of a pre-intersection road segment, wherein the vehicle traveled the pre-intersection road segment before traveling through an intersection;

receive a plurality of instances of post-intersection probe data, each instance being from a probe apparatus of the plurality of probe apparatuses, wherein an instance of the plurality of instances of post-intersection probe data comprises (a) the probe identifier corresponding to the probe apparatus, (b) a post-intersection travel speed at which the corresponding vehicle traveled at least a portion of a post-intersection road segment, and (c) information identifying the post-intersection road segment, wherein the vehicle traveled the post-intersection road segment after traveling through the intersection;

cluster instances of the plurality of instances of pre-intersection probe data based on the post-intersection road segment corresponding to each instance to generate two or more pre-intersection clusters;

cluster instances of the plurality of instances of post-intersection probe data based on the post-intersection road segment corresponding to each instance to generate two or more post-intersection clusters;

determine a pre-intersection traffic level indicator for each pre-intersection cluster probe data based on a pre-intersection travel speed for the corresponding pre-intersection cluster;

determine a post-intersection traffic level indicator for each cluster of post-intersection probe data based on a post-intersection speed for the corresponding post-intersection cluster; and responsive to determining that at least one traffic level indicator difference satisfies a threshold requirement, identify the intersection as experiencing a traffic jam.

14. An apparatus according to claim 13, wherein to determine a traffic level indicator for a road segment the at least one memory and the computer program code are configured to, with the processor, cause the apparatus to at least:

determine a road segment type for the road segment;

identify a road segment type normalization factor for the road segment type;

based on the probe data, determine a ratio of average travel speed for the road segment to a free flow speed for the road segment; and apply the road segment type normalization factor to the ratio.

15. An apparatus according to claim 13, wherein:

a first instance of the plurality of instances of post-intersection probe data comprises a first probe identifier and information identifying a first post-intersection road segment, and based on a first instance of the plurality of instances of pre-intersection probe data comprising the first probe identifier, the first instance of the plurality of instances of pre-intersection probe data is clustered into a first pre-intersection cluster, a second instance of the plurality of instances of post-intersection probe data comprises a second probe identifier and information identifying a second post-intersection road segment, and based on a second instance of the plurality of instances of pre-intersection probe data comprising the second probe identifier, the second instance of the plurality of instances of pre-intersection probe data is clustered into a second pre-intersection cluster, the first post-intersection road segment is different from the second post-intersection road segment and the first pre-intersection cluster is different from the second pre-intersection cluster.

16. An apparatus according to claim 15, wherein:

a first pre-intersection traffic level indicator is determined based on an average first pre-intersection travel speed determined corresponding to the first pre-intersection cluster, and a second pre-intersection traffic level indicator is determined based on an average second pre-intersection travel speed determined corresponding to the second pre-intersection cluster.

17. An apparatus according to claim 16, wherein:

the first instance of the plurality of instances of post-intersection probe data is clustered into a first post-intersection cluster, the second instance of the plurality of instances of post-intersection probe data is clustered into a second post-intersection cluster, a first post-intersection traffic level indicator is determined based on an average first post-intersection travel speed determined corresponding to the first post-intersection cluster, a second post-intersection traffic level indicator is determined based on an average second post-intersection travel speed determined corresponding to the second post-intersection cluster, the at least one memory and the computer program code are further configured to, with the processor, cause the apparatus to at least:

determine a first travel level indicator difference by determining a difference between the first pre-intersection traffic level indicator and the first post-intersection traffic level indicator; and determine a second travel level indicator difference by determining the difference between the second pre-intersection traffic level indicator and the second post-intersection traffic level indicator.

18. An apparatus according to claim 13, wherein, in response to identifying that the intersection is experiencing a traffic jam, the at least one memory and the computer program code are further configured to, with the processor, cause the apparatus to provide a traffic jam notification to a computing entity, wherein responsive to receiving the traffic jam notification, the computing entity processes the traffic jam notification and, responsive to the processing, provides a traffic jam alert through a user interface of the computing entity, wherein the computing entity comprises at least one of a probe device or a traffic management apparatus.

19. An apparatus according to claim 18, wherein in response to receiving the traffic jam notification, the computing entity (a) recalculates a route for traveling from a start location to a destination location or (b) determines an updated arrival or travel time.

20. A computer program product comprising at least one non-transitory computer-readable storage medium having computer-executable program code instructions stored therein, the computer-executable program code instructions comprising program code instructions configured to:

receive a plurality of instances of pre-intersection probe data, each instance being from a probe apparatus of a plurality of probe apparatuses, the probe apparatus comprising a plurality of sensors and on board a vehicle, wherein an instance of the plurality of instances of pre-intersection probe data comprises (a) a probe identifier configured to identify the corresponding probe apparatus and (b) a pre-intersection travel speed at which the corresponding vehicle traveled at least a portion of a pre-intersection road segment, wherein the vehicle traveled the pre-intersection road segment before traveling through an intersection;

receive a plurality of instances of post-intersection probe data, each instance being from a probe apparatus of the plurality of probe apparatuses, wherein an instance of the plurality of instances of post-intersection probe data comprises (a) the probe identifier corresponding to the probe apparatus, (b) a post-intersection travel speed at which the corresponding vehicle traveled at least a portion of a post-intersection road segment, and (c) information identifying the post-intersection road segment, wherein the vehicle traveled the post-intersection road segment after traveling through the intersection;

cluster instances of the plurality of instances of pre-intersection probe data based on the post-intersection road segment corresponding to each instance to generate two or more pre-intersection clusters;

cluster instances of the plurality of instances of post-intersection probe data based on the post-intersection road segment corresponding to each instance to generate two or more post-intersection clusters;

determine a pre-intersection traffic level indicator for each pre-intersection cluster probe data based on a pre-intersection travel speed for the corresponding pre-intersection cluster;

determine a post-intersection traffic level indicator for each cluster of post-intersection probe data based on a post-intersection speed for the corresponding post-intersection cluster; and responsive to determining that at least one traffic level indicator difference satisfies a threshold requirement, identify the intersection as experiencing a traffic jam and provide a traffic jam notification identifying the intersection to at least one computing entity, the at least one computing entity configured to perform a navigation function based at least in part on the traffic jam notification.

* * * * *